US009745125B2

(12) United States Patent
McConnell et al.

(10) Patent No.: US 9,745,125 B2
(45) Date of Patent: Aug. 29, 2017

(54) DISPOSABLE BAG AND THE METHOD OF USING THE SAME

(71) Applicant: Thomas E McConnell, Santa Ynez, CA (US)

(72) Inventors: Thomas E. McConnell, Santa Ynez, CA (US); Yafei Lu, Pizhou (CN)

(73) Assignee: Thomas E. McConnell, Santa Ynez, CA (US)

( * ) Notice: Subject to any disclaimer, the term of this patent is extended or adjusted under 35 U.S.C. 154(b) by 218 days.

(21) Appl. No.: 14/473,776

(22) Filed: Aug. 29, 2014

(65) Prior Publication Data

US 2016/0060026 A1 Mar. 3, 2016

Related U.S. Application Data

(63) Continuation-in-part of application No. 14/473,685, filed on Aug. 29, 2014, now Pat. No. 9,434,537.

(51) Int. Cl.

| | |
|---|---|
| ***B65D 33/00*** | (2006.01) |
| ***B65F 1/00*** | (2006.01) |
| ***B65F 1/06*** | (2006.01) |
| ***B65F 1/08*** | (2006.01) |
| ***B65F 1/10*** | (2006.01) |
| ***B65F 1/16*** | (2006.01) |
| *B65D 88/16* | (2006.01) |
| *B65B 7/12* | (2006.01) |

(52) U.S. Cl.

CPC ..... *B65F 1/0006* (2013.01); *B65F 1/06* (2013.01); *B65F 1/08* (2013.01); *B65F 1/10* (2013.01); *B65F 1/1607* (2013.01); *B65B 7/12* (2013.01); *B65D 88/1606* (2013.01); *B65D 88/1612* (2013.01); *B65D 88/1618* (2013.01); *B65F 1/1623* (2013.01); *B65F 2001/1676* (2013.01); *B65F 2210/1675* (2013.01); *B65F 2220/128* (2013.01); *B65F 2240/132* (2013.01); *Y10S 220/908* (2013.01); *Y10S 220/9081* (2013.01)

(58) Field of Classification Search

CPC .. B65F 1/06; B65F 1/062; B65F 1/067; B65F 1/068; B65F 1/0013; B65F 1/065; B65D 88/1606; B65D 88/1612; B65D 88/1618; Y10S 220/908; Y10S 220/9081; B65B 7/12

USPC ..... 220/495.06, 495.08, 908, 908.1; 383/33, 383/34, 34.1, 35, 71, 906; 222/478; 53/483, 370

See application file for complete search history.

(56) References Cited

U.S. PATENT DOCUMENTS

| | | | | |
|---|---|---|---|---|
| 3,321,103 A | | 5/1967 | Phillips | |
| 4,610,039 A | | 9/1986 | Stern | |
| 5,061,086 A | * | 10/1991 | Vallerga | A45C 1/00 150/102 |

(Continued)

*Primary Examiner* — Fenn C Mathew
*Assistant Examiner* — Elizabeth Volz
(74) *Attorney, Agent, or Firm* — WPAT, P.C., Intellectual Property Attorneys; Anthony King

(57) ABSTRACT

A method of quick and easy diaper management by providing a collar ring on the upper rim of a garbage bag, such that the collar ring snugly fits over a diaper pail. Further, the garbage bag has attachments points on its body portion so the body portion can be anchored to the diaper pail. The ring collar has receiving structures such as a notch so that a user may seal tie the garbage bag by simply twisting its neck and then insert the twisted neck into the receiving structure on the collar.

19 Claims, 22 Drawing Sheets

(56) References Cited

U.S. PATENT DOCUMENTS

| | | | | |
|---|---|---|---|---|
| 5,125,526 | A | 6/1992 | Sumanis | |
| 5,478,152 | A * | 12/1995 | Bogle | B65B 67/1222 220/9.4 |
| 8,266,870 | B1 | 9/2012 | Stravitz | |
| 2007/0029328 | A1* | 2/2007 | Polisano | B65F 1/06 220/495.08 |
| 2007/0031068 | A1* | 2/2007 | Gillis | A61J 19/00 383/33 |
| 2008/0019618 | A1* | 1/2008 | Dayton | B65D 33/25 383/61.1 |

* cited by examiner

DISPOSABLE BAG AND THE METHOD OF USING THE SAME

CROSS-REFERENCE TO RELATED APPLICATIONS

This application claims priority to, and is a Continuation-In-Part of, U.S. patent application Ser. No. 14/473,685, filed on Aug. 29, 2014, now pending, which is hereby incorporated by reference in its entirety. Although incorporated by reference in its entirety, no arguments or disclaimers made in the parent application apply to this Continuation-In-Part application. Any disclaimer that may have occurred during the prosecution of the above-referenced application is hereby expressly rescinded. Consequently, the Patent Office is asked to review the new set of claims in view of all of the prior art of record and any search that the Office deems appropriate.

BACKGROUND OF THE INVENTION (1) Field of the Invention

The field of the invention is bag enclosures, more specifically, garbage bags.

(2) Description of Related Art Including Information Disclosed Under 37 CFR 1.97 and 1.98

Various types of garbage bags are known and used in everyday life. Typically a garbage bag is made of plastic sheets. In prior art garbage bags, the mouth of the bag has cinching straps, allowing a user to cinch the bag closed when the bag is full.

Other ways to close the bag includes tying a knot. There is a continuing need for new ways to close a garbage bag when the bag is full.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The invention may seek to satisfy one or more of the above-mentioned desires. Although the present invention may obviate one or more of the above-mentioned desires, it should be understood that some aspects of the invention might not necessarily obviate them.

BRIEF SUMMARY OF THE INVENTION

One aspect of the invention is directed to a disposable bag assembly having necessary hardware intended for quick and easy installation into a diaper pail system. In another aspect of the invention, the disposable bag assembly is not only for a particular diaper pail, but is universally acceptable for use in garbage cans, so long as its collar structure is appropriately sized and shaped to fit over the upper rim of the garbage can. In some other embodiments, the invention is directed to a disposable bag with a collar, wherein the collar has a receiving structure so a user may use the receiving structure to receive the twisted neck of the bag, thereby effectively sealing the bag.

In one contemplated embodiment, the receiving structure is a notch, which can be located on various part of the collar. In the preferred embodiment, only one notch is required. The notch can be a cutout that serves as a catch to hook a twisted neck of the disposable bag. In operation, the user would remove the bag from the waste container, tilt the collar, twists the neck portion by turning the body portion of the bag, and then fittingly receive the twisted neck into the notch. The collar can then be used as a handle to carry the full disposable bag.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

It should be noted that the drawing figures may be in simplified form and might not be to precise scale. In reference to the disclosure herein, for purposes of convenience and clarity only, directional terms, such as, top, bottom, left, right, up, down, over, above, below, beneath, rear, front, distal, and proximal are used with respect to the accompanying drawings. Such directional terms should not be construed to limit the scope of the invention in any manner.

DETAILED DESCRIPTION OF THE INVENTION

The invention and its various embodiments can now be better understood by turning to the following detailed description of the preferred embodiments, which are presented as illustrated examples of the invention defined in the claims. It is expressly understood that the invention as defined by the claims may be broader than the illustrated embodiments described below.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed herein even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Figure 1A:
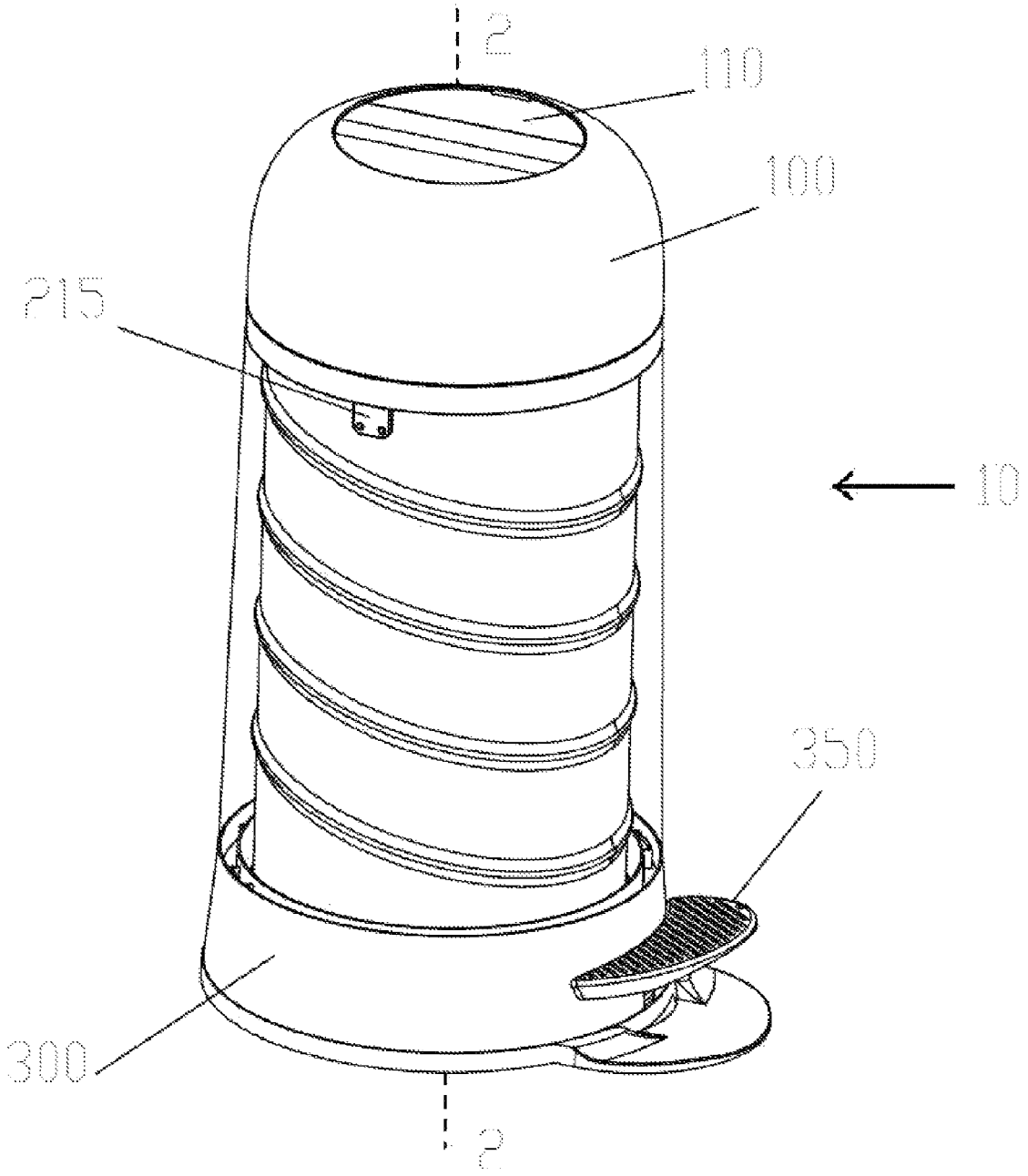
FIG. 1A is a perspective view of a first embodiment of a diaper pail having a transparent outer barrel.

FIG. 1A generally depicts a preferred embodiment of a diaper pail or container assembly 10. In FIG. 1A, the container assembly 10 is shown having a base 300 with a pedal 350 protruding out of the base 300. Coupled to the base 300 is an inner barrel 210 having an inner volume and an outer barrel casing 200 enclosing/encasing the outer circumference of the inner barrel 210. Preferably there is sufficient clearance between the inner barrel and the outer barrel, so that the inner barrel can freely rotate without touching the outer barrel. The inner barrel 210 shown has some kind of spiral blade on its outside surface, this spiral blade does not aid in driving or rotating the inner barrel 210. This spiral blade does not interact or engage with the outer barrel 200. The illustrated spiral blade is one of the contemplated designs on the inner barrel 210 to create visual stimulation. In the depicted embodiment, the outer barrel casing 210 is transparent, and the inner barrel casing 210 can be seen through the transparent outer barrel casing 200, as the inner barrel casing 210 rotates. Other contemplated embodiments may feature designs on the outer barrel casing 200. Yet other contemplated embodiments feature a partly opaque outer barrel casing 200. Yet another contemplated embodiment features a completely opaque outer barrel casing 200. In the upper region of the container assembly 10 is a top 100 having two pivoting doors 110. In other embodiments, the top has at least one pivoting door. In less preferred embodiments, the top does not have a pivoting door. In the depicted embodiment, the inner barrel 210 has at least one attachment mechanism 215 on the inner barrel.

Although the word barrel usually describes a tubular object having a circular cross-sectional shape, it is specifically noted here that the word barrel in the specification has no specific limitation or restriction on its cross-sectional shape.

Figure 1B:
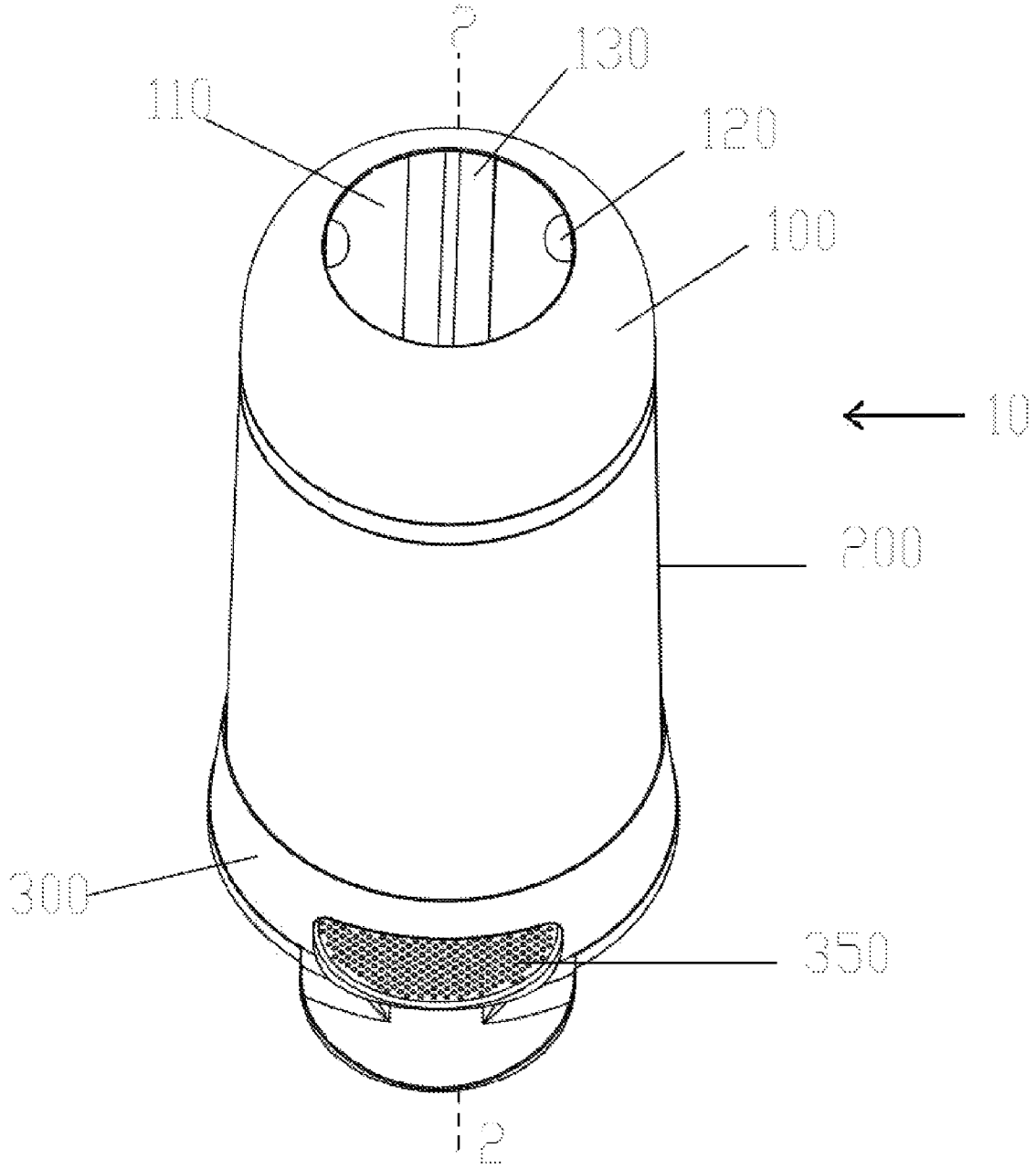
FIG. 1B is a top angled perspective view of the diaper pail of FIG. 1A (the outer barrel is not shown to be transparent, for easier illustration).

FIG. 1B shows another view of the diaper pail or container assembly 10 looking downwards through the two pivoting transparent door panels 110 (closed as shown) into the inner space of the container assembly 10. The door panels 110 are coupled to the top 100 with a resilient piece 120. The resilient piece 120 is sufficiently strong to bias the door panels 110 shut, yet allows for the door panels 110 to swing open in a downward direction when a dirty diaper falls onto the door panels 110, thereby allowing the dirty diaper to fall through the door panels 110. After the waste is passed through the door panels 110, the door panels 110 swing shut. In contemplated embodiments, the resilient piece 120 is made of silicone. In other embodiments, the resilient piece is 120 made of a resilient material such as rubber. In further contemplated embodiments, the resilient piece 120 is a leave spring or coil spring.

The shown embodiment further shows a seal 130 between the two door panels 110. In keeping with its designated term, the seal 130 serves to seal the two door panels 110 when they overlap, to retain and prevent odors from seeping out. In contemplated embodiments, the seal 130 is a long flexible strap made of a material such as rubber, silicone, and the like . . . to attach to one, or both door panels 110 at their far ends away from the resilient piece 120. The purpose of the seal 130 is to form a secure temporary substantial airtight closure when the two doors 110 close on each other. This way, the flexible seal 130 of one door panel overlaps with the flexible seal 130 of other door panel, making a tight seal. In an embodiment where each door 110 has a seal 130, the two flexible seal 130 would overlaps each other when the doors 110 are closed, making a tight seal. In less preferred embodiments, the door panels 110 do not have a seal 130.

The term door or door panel refers to generally known means for a user to divide and separate space. Contemplated door or door panels are selectively operated by a user. Doors or door panels are not limited to those that pivot on a hinge. The door or door panels can come in various forms, such as those shown and discussed above. In other alternative embodiments, a door or doors can be shutter blades similar to those seen in cameras. Shutter blades can be operated and driven mechanically or electronically. No matter which form of door or doors is implemented, the door or doors can be operated manually (e.g., via a button or lever), or operated/controlled electronically via sensors (e.g., weight sensor, motion sensor, light sensor). In some embodiments, the door or doors are driven by a motor. In further embodiments, the door or doors are controlled by a remote controller via wire or wirelessly.

Figure 2:
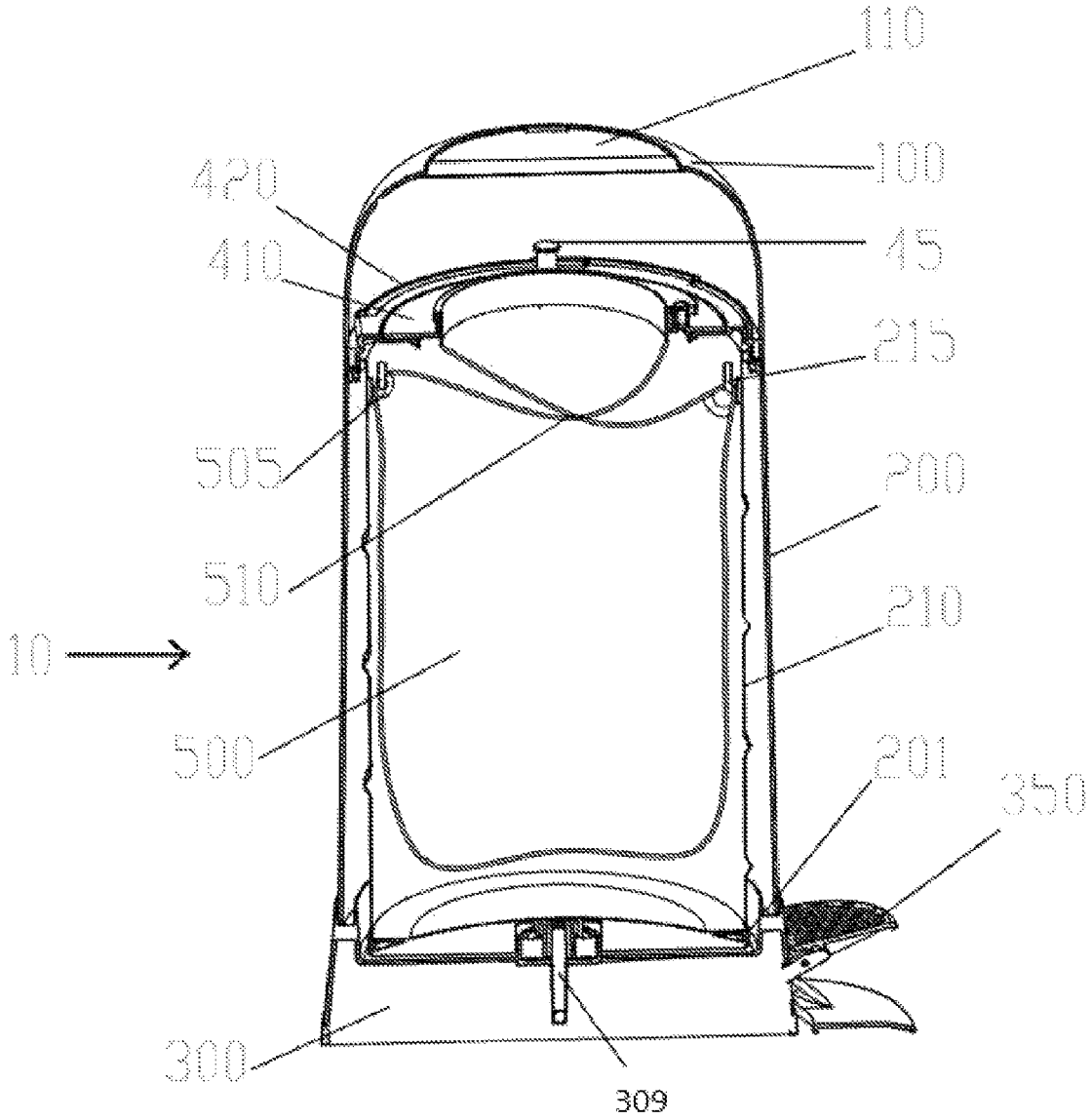
FIG. 2 is a vertical cross-sectional view taken along line 2-2 of FIGS. 1A and 1B.

FIG. 2 depicts cross-sectional view of the container assembly 10 taken along line 2-2 of FIG. 1A. A disposable bag 500 is mounted within the container assembly 10. In the depicted embodiment, a neck 510 of the disposable bag 500 is twisted in a closed formation. The base 300 has a rotatable axle 309 on which a barrel base 201 of the inner barrel 210 is coupled to. When the foot pedal 350 is at rest, the neck 510 of the disposable bag 500 is in a twisted-closed formation. When the foot pedal 350 is compressed, the inner barrel 210 rotates in a first direction untwisting the neck 510 of the disposable bag 500 to an open formation. When the foot pedal 350 is released, the inner barrel 210 rotates in a second direction returning the disposable bag 500 to the closed formation.

It should be noted that U.S. Pat. No. 5,125,526 teaches a garbage can where the top lid opens simultaneously with the untwisting of its bag. In other words, their actions are synchronized, and for desirous reasons. The inventors of the current application, however, surprisingly discovered the advantages of having such top lid (door 110) moving independently of an untwisting of the bag 500. Accordingly, in preferred embodiments, the actuated change in open or closed formation of the disposable bag 500 is independent of the movement of the top transparent doors 110. That is, when waste such as a dirty diaper is dropped through the door 110, the user-actuated change into open formation of the disposable bag 500 does not occur simultaneously. The top doors 110 facilitate touch-free passage of a dirty diaper through the top 100 so a user may simply drop the dirty diaper on top of the doors 110 without physically touching any part of the waste disposal system. The dirty diaper is to pass through the top door 110 and rest atop the twisted-closed neck 510 of the disposable bag 500. This advantageously allows a user to keep the dirty diaper in the sealed top chamber, and then compress the pedal 350 to untwist and open the bag 500, thereby keeping malodorous gas within the diaper pail when the dirty diaper drops into the cavity of the bag 500. This way, when a user deposits the dirty diaper, malodorous gas from within the inner cavity of the bag 500 does not immediately escape through the top transparent door 110 and into his/her face. Once the pedal 350 is released, the bag 500 twists closed thereby retaining undesirable odors inside.

In the embodiments shown in the drawings, a foot pedal 350 is shown. A foot pedal 350 is only one type of contemplated actuators. The preferred embodiments may use other types of actuators, such as a motion sensor, a weight sensor, a button, or a handle. The purpose of the actuator is for a user to pass on command (either electronically or mechanically) to the base, which contains corresponding mechanism (gears, electronic motor, rotating axle, etc.) to rotate the inner barrel 210. In the case of a motion sensor, a user would simply wave his/her hand or foot in front of the motion sensor to activate it, which in turn activates an electric motor in the base 300, causing the motor to rotate the inner barrel 210. Alternatively, the motion sensor can be installed inside of the top chamber to detect whenever the top doors 110 move, or whenever a dirty diaper enters into the top chamber. In one embodiment, the diaper pail allows a few seconds of delay before an electric motor in the base 300 is activated to turn the inner barrel 210. These few seconds of delay allow the top transparent doors 210 to completely close, before untwisting of the bag 500. In the case of a weight sensor, the weight sensor maybe installed at a place that would detect a dirty diaper entering into the top chamber and dropping onto the twisted-closed neck of bag 500. Likewise, the weight sensor activates an electric motor in the base 300 to rotate the inner barrel 210. In a preferred embodiment, there is provided a few seconds of delay, allowing the transparent top doors 110 to close before untwisting the bag 500.

Furthermore, in preferred embodiments, there is at least 5 cm of clearance height between the top surface of the door 110 and an upper rim of the disposable bag 500 when the door 110 is closed. This allows for sufficient space for the waste material to pass through the top doors 110 and for the top door 110 to swing shut thereafter, while the waste material remains in the top chamber. Alternatively, the clearance height is at least 6 cm. In yet another embodiment, the contemplated clearance height is at least 7 cm; and other embodiments have a clearance height of 10 cm and above.

One purpose of the clearance height is to essentially create a closed chamber where a dirty diaper may stay temporarily, before it is disposed into the inner cavity of bag 500. Preferred chamber can be partially transparent, such as having transparent walls or doors 110, so a user may see whether or not the dirty diaper has successfully dropped in to the bag 500. As described earlier, one of the advantages this chamber provides is to be a temporary staging area for a dirty diaper, so that when a user opens the bag 500, the door 110 is already shut behind it, keeping malodorous gas contained entirely within the container assembly 10.

While the word chamber is used in the claims and throughout this specification, a chamber is not limited to a space confined by structural walls and narrow ingress and egress. The contemplated top chamber can be merely a clearance space between the topmost portion of the container assembly and a closed entrance of the disposable bag 500. In the illustrated examples, the closed entrance is where the neck of the bag 500 twists shut. In other contemplated examples, the disposable bag 500 does not twist, instead, the closed entrance is where the neck of the bag 500 is mechanically folded shut, or clamped shut. In more mechanically or electrically complicated embodiments, the bag 500 does not twist, and there is no rotating inner barrel, the closed entrance to the bag is another door or set of doors that open and close independent of the top door 110. In such embodiments, a waste material enters through top door 110, and remains in the chamber region before the second set of doors open to let the waste material fall into the bag 500. In further embodiments, the bag simply hangs in the container, with a clearance space between a top door and a second door, where the two doors are independently operated/controlled. In embodiments where a twisting of the bag in not necessary, one may use a bucket (enclosed within the container assembly) or other type of enclosure, instead of a bag, to catch/hold waste material.

One of the main purposes of the inventive subject matter is to have a waste container to hold waste materials (e.g., dirty diapers) inside, and provide two separately operated/controlled sets of doors. And the waste material is allowed to stay in a staging area between the two doors, before allowing the waste material to drop further into the container (which may have a bag, or a bucket, any enclosure, or nothing to catch the waste). One of ordinary skill in the art would immediately recognize a number of different mechanical/electrical/electro-magnetic ways to accomplish this agenda.

It should be noted that, conventionally it is considered unsightly to have a trash can with a transparent door, transparent top, or a transparent body. Conventional wisdom dictates that such transparent structure is undesirable because the idea of having a trash can is to place waste objects out of sight. As demonstrated in the many embodiments disclosed herein, the inventors have surprisingly discovered novel methods and advantages by making various parts of a waste container assembly 10 transparent.

Figure 6A:
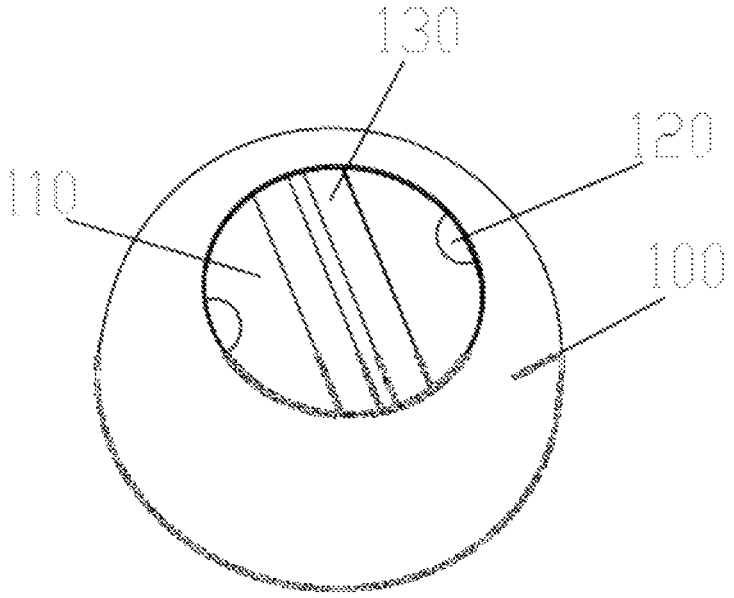
FIG. 6A is a perspective view of the top having two door panels.
Figure 6B:
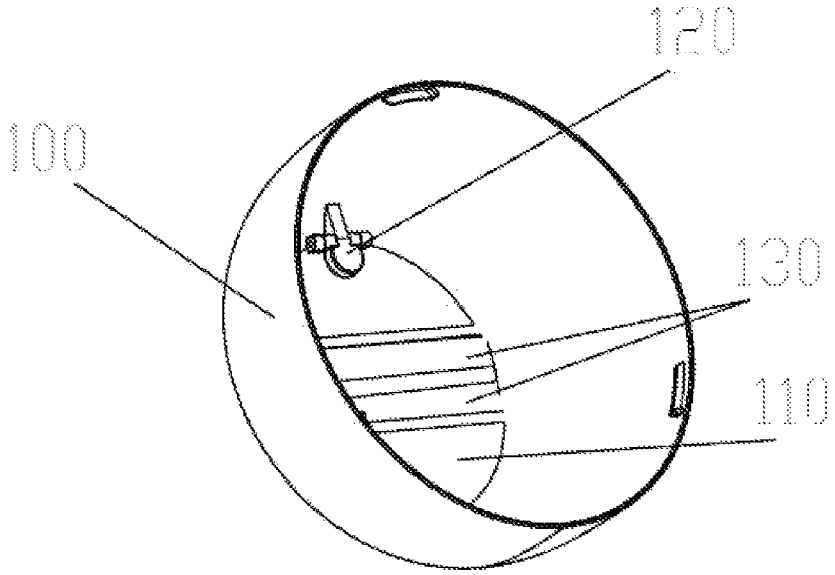
FIG. 6B is a perspective view of the inside of the top of FIG. 6A, while the top is turned upside down.

Another advantage of having transparent top doors 110 is to give a user the ability to visually inspect the fullness of the bag 500 without risking malodorous gas escaping. Because doors 110 are transparent, the user may simply compress the food pedal 350 and look down into the bag 500, while the top transparent doors 110 remain shut, keeping malodorous gas in. All of this can be done without risking escaping malodorous gas, because the top chamber essentially acts as the barrier. FIGS. 6A and 6B show the top 100 of the diaper pail. The top 100 is in a form of a lid, and its interior space is essentially the top chamber.

While top 100 is shown in the form of a detachable lid, many other contemplated configurations are possible. For example, the top 100 can be made as an integral part of outer barrel, and the disposable bag 500 can be inserted/removed through a much larger top door 110. In another less preferred embodiment, the disposable bag 500 can be inserted/removed through a side door (through both the inner barrel and the outer barrel).

Referring now to FIG. 2 with respect to bag attachment mechanisms, FIG. 2 features at least one bag attachment mechanism 215 in the inner barrel 210. In preferred embodiments, there are two bag attachment mechanisms 215 located directly opposite one another on the inside of the inner barrel 210. In some embodiments, the disposable bag 500 has at least one receiver 505 to make detachable coupling to the at least one bag attachment mechanism 215. In the depicted embodiment, the disposable bag 500 is detachably coupled to the inner barrel 210 at the attachment mechanisms 215, while the top rim of the bag 500 is coupled to parts of the outer barrel casing 200. In contemplated embodiments the receiver 505 is one of a hole, a sleeve, a reinforced hole, and a reinforced tab. In FIG. 2, the two receivers on the bag 500 are reinforced holes, and the bag attachment mechanism 215 on the inner barrel 210 is two hooks. By detachably attaching the receiver 505 of the disposable bag 500 to the inner barrel 210, the bag 500 can rotate with the inner barrel 210 (while the top rim of the bag remains stationary) in one direction to an open formation, then rotate the bag 500 in another direction to closed formation (while the top rim of the bag remains stationary). In the embodiments of FIG. 2, this is done by compressing and releasing the foot pedal 350. Other contemplated attachment mechanisms 215 include a peg, or a clip. Also contemplated is where the inner barrel 210 uses mechanical structures such as clips, folds, tentacles, protuberance, or any surface material (even flat rubbery surface) to cause friction with the disposable bag 500 to grasp the bag 500, and the bag 500 is not required to have corresponding structure. This way, a user may use any typical garbage bag in the inner barrel 210, and the contemplated inner barrel can still twist the body of the bag 500 in relation to the top rim of the bag 500.

Further depicted in FIG. 2 is another bag attachment mechanism, the purpose of which is to couple the top rim of the bag 500 to the outer barrel casing 200. This way, when the body of bag 500 rotates along with inner barrel 210, the top rim of the bag 500 can remain stationary along with the outer barrel casing 200. As shown in FIG. 2, this top rim attachment mechanism can be a frame assembly 400 disposed on top of the inner barrel 210. Most preferably, the frame assembly 400 is disposed above the inner barrel 210, but does not have physical contact with the inner barrel 210. A top rim (open edge) of the bag 500 is removably mounted onto the inner circumference of the frame assembly 400. The frame assembly 400 is comprised of a roller base 420 and a bag roller 410. The bag roller 410 is configured to rotate or spin by hand, relative to the roller base 420. In the pictured embodiment, a user may pull out and hold protruding peg 45, and then manually move the protruding peg 45 in a rotating direction to move the bag roller 410. Releasing peg 45 locks the peg 45 in position when needed, especially after the top rim of the bag is rotated, thereby twisting its neck. Less preferred embodiments do not feature the peg 45. The purpose of the peg 45 and the bag roller 410 is for a user to "preload" the disposable bag 500 into a twisted-closed formation. In operation, to install a bag 500 a user would first remove or tilt open the top 100 and the frame assembly 400 from the container assembly 10. Now that the inner barrel 210 is exposed, the user would place bag 500 into the inner barrel 210, and attach body of the bag 500 to bag attachment mechanism 215 on the inner barrel 210. After the bag is secured to the inner barrel 210, the user would next install the frame assembly 400 onto the container assembly 10 (while the bag is entirely within the inner barrel 210). The user would next reach his/her hand through the center opening of the frame assembly 400, and pull the top rim of the bag 500 through the center opening of the frame assembly 400. The idea is to next fasten the top rim of the bag 500 to the frame assembly by necessary means, and then manually "preload" the disposable bag 500 by twisting close its neck.

Still further contemplated embodiments feature a ridge on the bag roller 410 to spin relative to the roller base 420. In yet another contemplated embodiment, the bag roller 410 features a space or opening to fit a finger or fingers to rotate the bag roller 410.

Alternatively, the top rim bag attachment mechanism can also be simple mechanical means such as hooks, pegs, or clips, to grasp and fasten the top rim of bag 500 to a frame assembly 400.

Figure 3A:
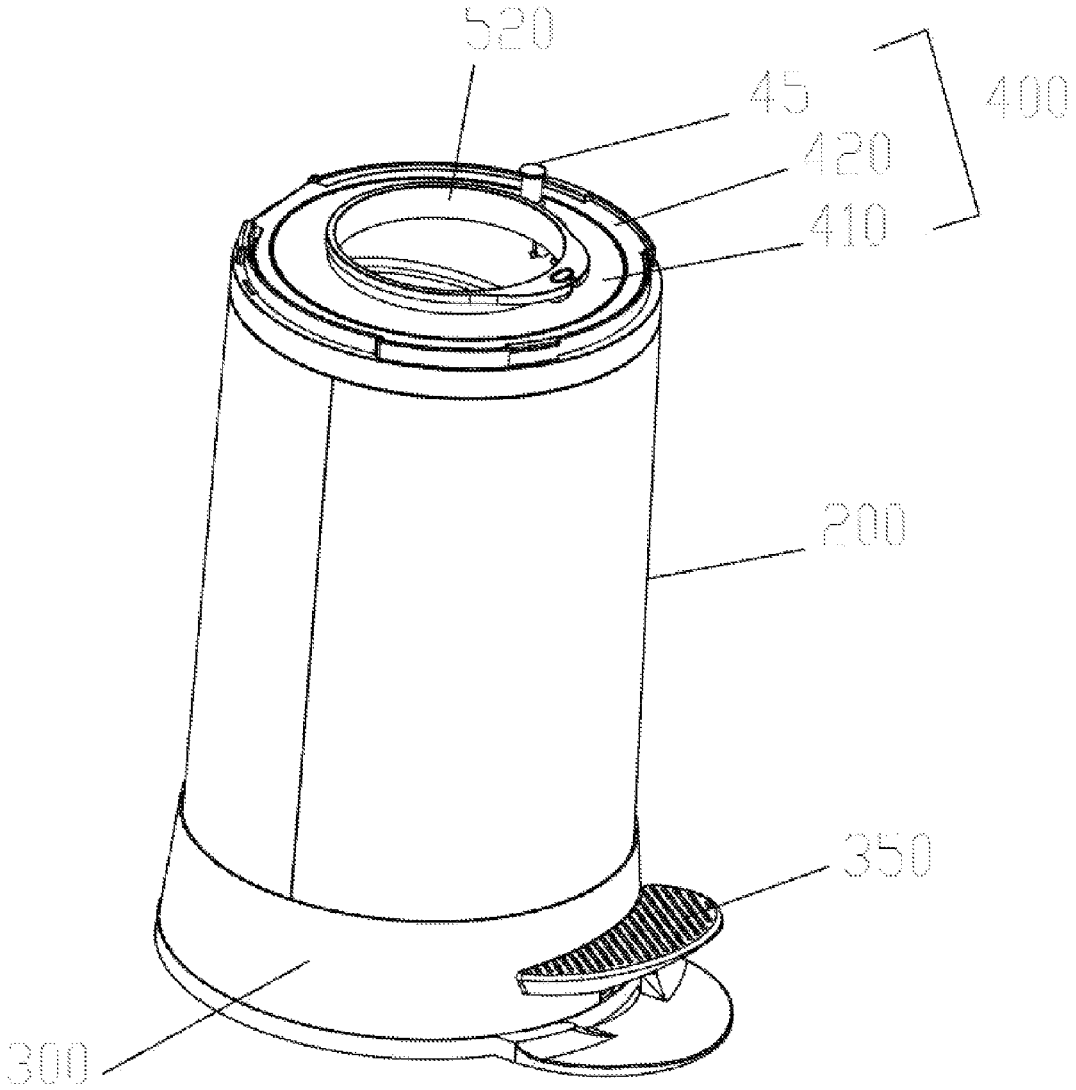
FIGS. 3A and 3B are top angled perspective views of the diaper pail of FIG. 1A with the top removed, where the bag assembly has a collar of FIG. 12B mounted on the frame assembly (the bag body portion is not shown for easier illustration).
Figure 3B:
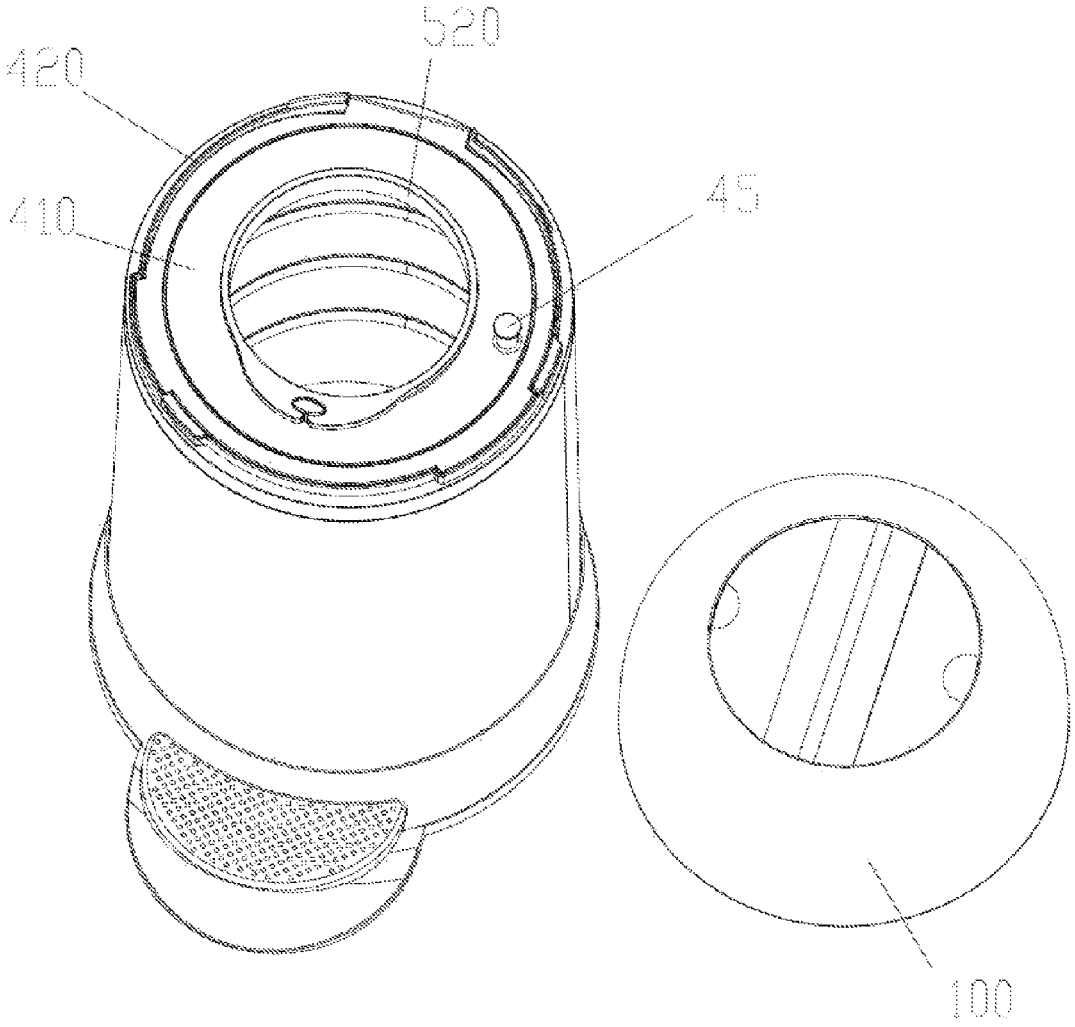

FIGS. 3A and 3B depict a diaper pail 10 with its top 100 removed for better illustration. From the depicted view, a contemplated embodiment of the frame assembly 400 is shown. In the depicted embodiment, the frame assembly 400 is positioned above the inner barrel 210 and along the inner circumference of the upper end of the outer barrel casing 200. In FIGS. 3A and 3B, a user had already reached through the center opening of the frame assembly 400, and pulled out the top rim 520 of the bag 500. Here, the top rim 520 of the bag 500 happens to be a preformed collar 520 similar to FIGS. 12A and 12B. And for easier illustration, the bag assembly 500 in FIGS. 3A and 3B are not fully shown, only its collar 520 is shown. Or, alternatively, in FIG. 3B, the bag assembly 500 is shown having a collar 520 and a transparent bag body portion. Because the bag body portion is transparent, one may see through it and see the internal wall of the inner barrel 210. An overview of the various embodiments of the bag assembly 500 can be seen in FIGS. 10-15B. The user next removably mounts collar 520 along the inner circumference of the frame assembly 400, more specifically it is mounted on the bag roller 410. In contemplated embodiments, the ring or collar 520 is preformed with or coupled to the open end (top rim) of a disposable bag 500 (as shown in FIGS. 10, 11, 12A, 13A, 14A, and 15A). Now the bag 500 is fixed in position, where its top rim is removably mounted onto the frame assembly, and its body is detachably coupled to an attachment site of the inner barrel 210. Rotation of the inner barrel 210 now effectively twists the neck of the bag 500.

Figure 3C:
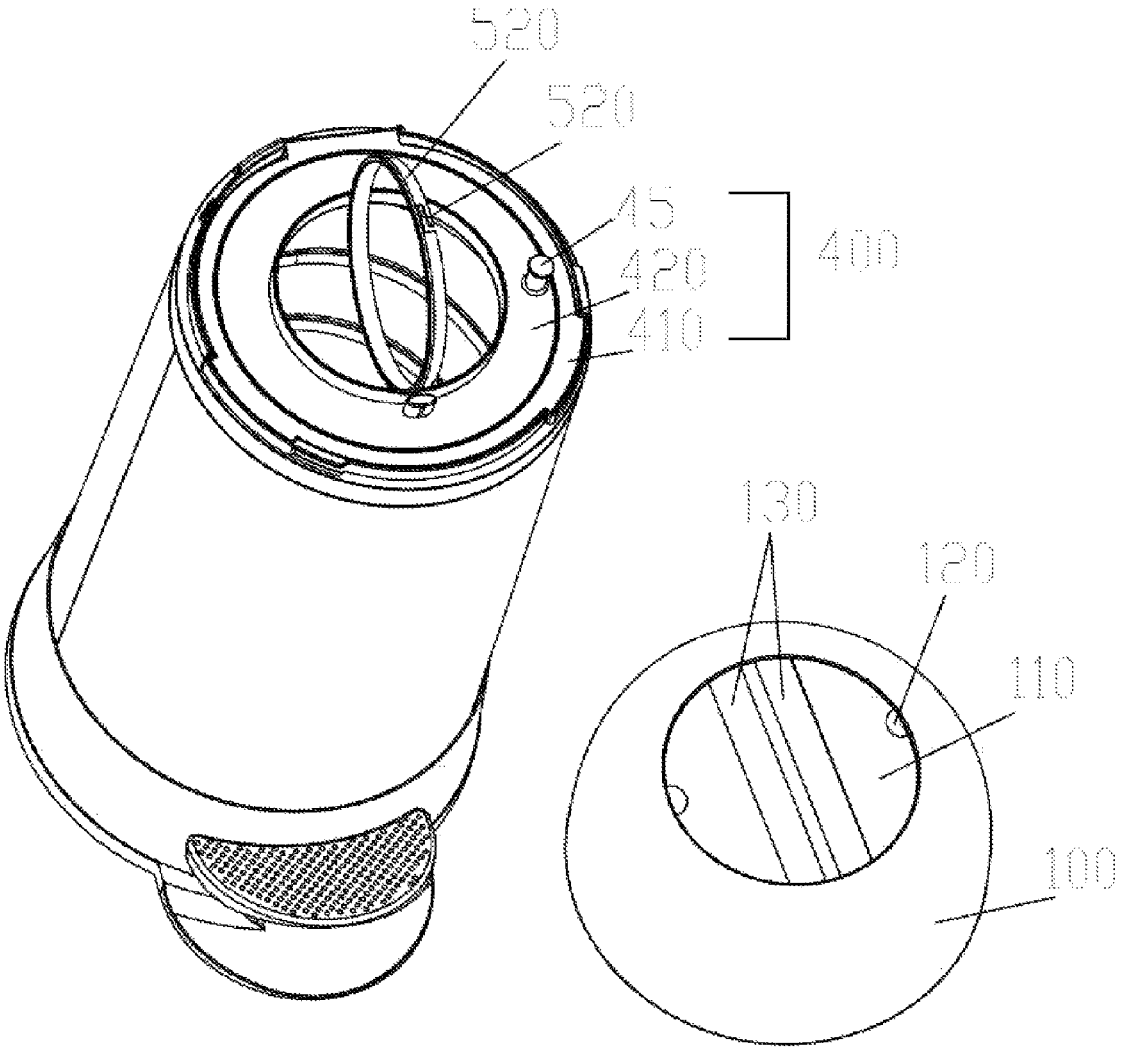
FIG. 3C is a top angled perspective view of the diaper pail of FIG. 1A, with the top removed, where the bag assembly has a collar of FIG. 14B not yet mounted on the frame assembly (the bag portion is not shown for easier illustration).

FIG. 3C is a perspective view of the diaper pail top 100 and the rest of the diaper pail 10 of FIG. 1A with a disposable bag collar 520 halfway pulled through the center hole of the frame assembly 400. In FIG. 3C, for better illustration purposes the rest of the bag 500 is not shown, and only the collar 520 of the bag is shown. In operation the bag 500 is always attached to the collar 520. In the preferred embodiments, the bag collar 520 is welded or somehow permanently coupled to a disposable plastic bag 500 by the manufacturer. Here in FIG. 3C, the collar 520 is sufficiently flexible so a user may squeeze it or deform it into an oval shape so the collar 520 can insert through the inner circumference of the frame assembly 400.

In another embodiment, the collar 520 can be individually provided without a permanently attached bag 500. In such embodiment, which looks like that shown in FIG. 3C, the collar 520 alone snaps in the rim of the center hole of the frame assembly, thereby acting as a first bag attachment. Basically, one would pull the open mouth of a conventional garbage bag from under the frame assembly 400 and through the center hole of the frame assembly 400. The user would then spread the mouth of the conventional garbage bag over the frame assembly. Next, the collar 520 by itself is snapped and wedged onto the inner rim of the center hole of the frame assembly, sandwiching the mouth of the conventional garbage bag in between.

Figure 4:
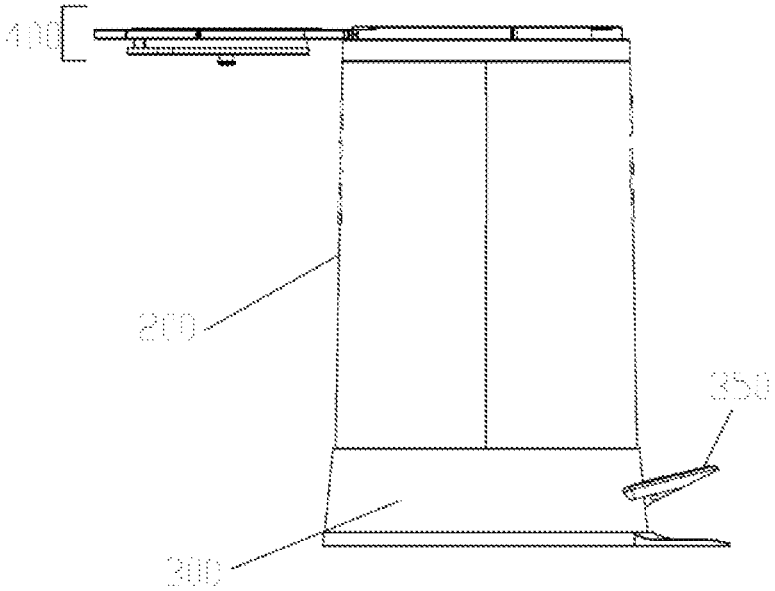
FIG. 4 is a side view of the diaper pail with the top removed and the frame assembly pivot open.
Figure 5:
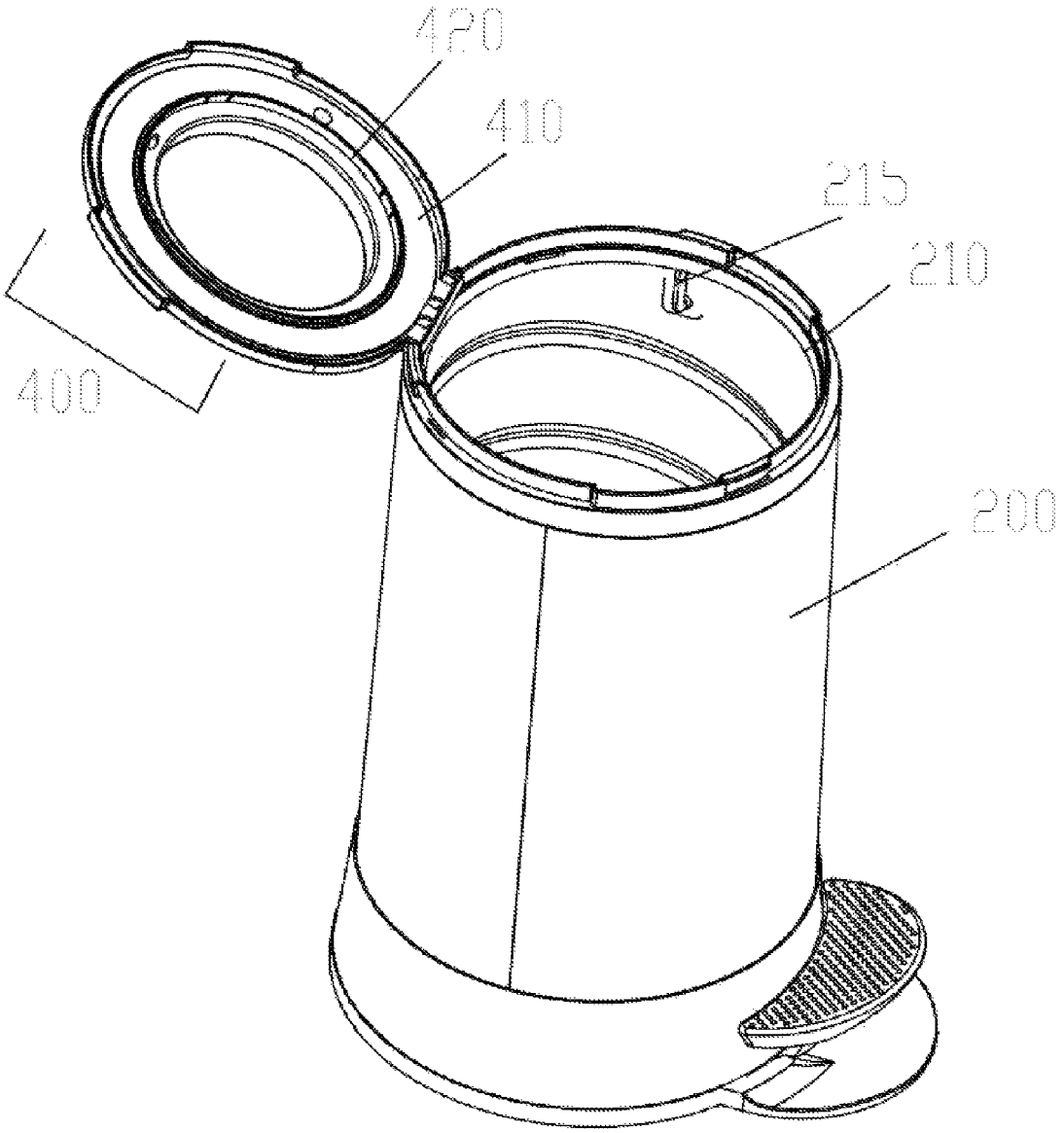
FIG. 5 is a top side perspective view of the diaper pail of FIG. 4.

FIGS. 4 and 5 show a preferred embodiment where the frame assembly 400 is pivotably coupled to the outer barrel casing 200. Here, the frame assembly 400 is pivoted open. FIG. 5 shows a close-up view of the frame assembly 400 coupled to the outer barrel casing 200 via a hinge. In this preferred embodiment, the frame assembly 400 is coupled to the outer barrel casing 200 via a hinge such that the frame assembly 400 can be flipped open when the disposable bag is full and should be removed or replaced. In less preferred embodiments, the frame assembly 400 is not pivotably attached to the outer barrel casing 200, and can be completely removed/detached from the diaper pail 10 in order to change a disposable bag 500.

Additionally, FIG. 5 further illustrates a close-up view of the bag attachment mechanism 215 located on the inside of inner barrel 210. In the depicted embodiment, the attachment mechanism 215 is a hook. Additionally, it should be appreciated that there are additional attachment mechanisms including a peg or a clip, and those contemplated herein may be derived in numerous manners.

FIG. 6A is a perspective view of the exterior of the top 100. FIG. 6B is a perspective view of the interior of the top 100 with the top 100 flipped upside down. Top 100 is detachably fastened to the outer barrel casing 200 by conventional methods such as being screwed on, or snapped into corresponding groves on the top rim of the outer barrel casing 200. In the pictured embodiment, the top has two pivoting transparent doors 110, each being semi-circular in shape. In general, preferred embodiments have at least one door panel 110 coupled to the top 100. Also shown is a close-up of the two seals 130, each of which is attached to the far ends of the two doors 110. When the two doors 110 close, their flexible seals 130 overlap each other, making an airtight seal. In the preferred embodiment, these seals 130 are also made of transparent material. Additionally, each of the doors 110 is biased shut via a resilient piece 120. The resilient piece 120 is coupled to the hinges and acts as a spring, yet resiliently allowing the doors to pivot open when a dirty diaper is dropped on the doors 110 based gravitational pull, thereby providing a touch-free means to dispose the dirty diaper. As mentioned previously, the resilient piece 120 includes and is not restricted to a spring coil, silicone or rubber piece. The resilient piece 120 must have sufficient spring tension such that after the door 110 opens, and the dirty diaper passes through, the door 110 will automatically swing back to its original position (shut).

Figure 7A:
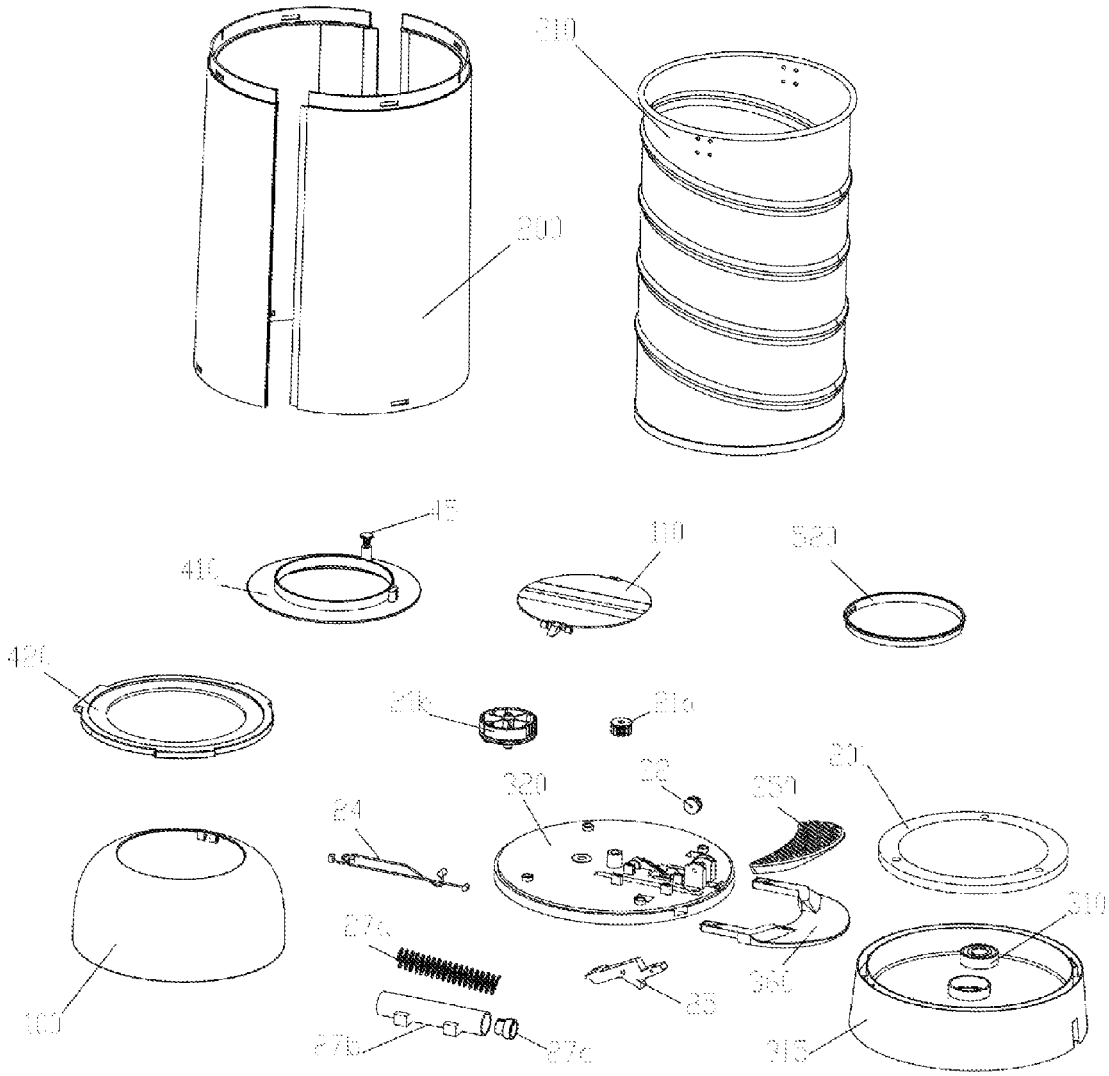
FIG. 7A is a perspective view of all the parts of the embodiment of FIG. 1A.
Figure 7B:
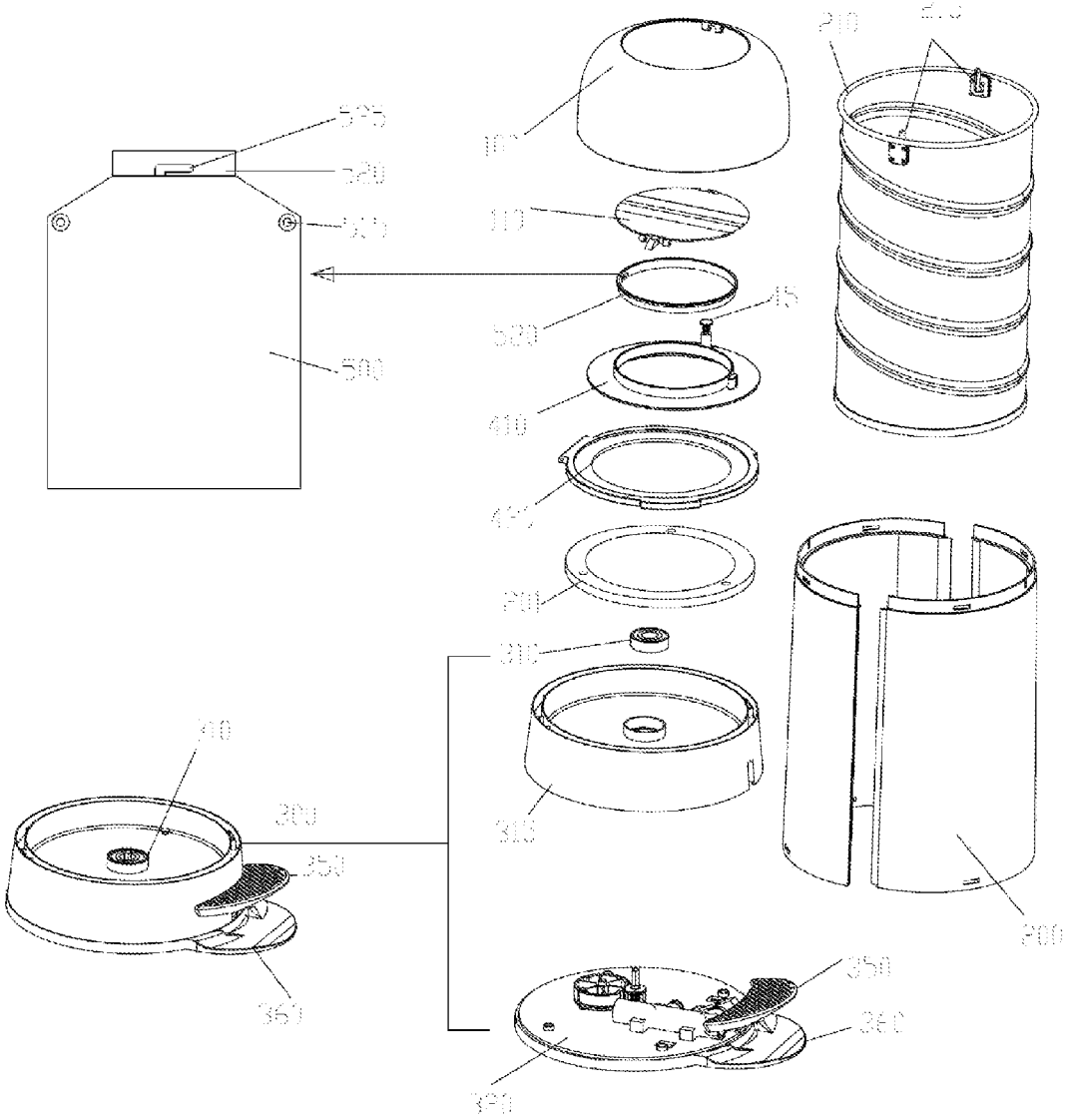
FIG. 7B is an exploded view of all the assembly parts of the embodiment of FIG. 1A.

FIG. 7A shows the assortment of the various parts in the diaper pail 10 of FIG. 1A. FIG. 7B is an exploded view of all the assembly parts of the embodiment of FIG. 1A. The exploded view in FIG. 7B features a top 100 and its top door 110. A bag collar 520 (which can or cannot be permanently attached to a bag 500, not shown) and frame assembly 400. The frame assembly 400 includes a peg 45 which fits into a slot in the bag roller 410, and the bag roller 410 rotates relative to the roller base 420. In the pictured embodiment, the inner barrel 210 fits onto an inner barrel base 201. The base 300 is comprised of a rotatable axle 309 (having a hexagonal cross-sectional shape), base cover 315, a base part 320, a bracing piece 360 and pedal 350. The inner barrel base 201 has a corresponding hexagonal female end to couple to the rotatable axle 309 such that the inner barrel 210 is driven by the rotation of the axle 309. In this embodiment, the outer barrel casing 200 is transparent and encases the circumference of the inner barrel 210.

Figure 8A:
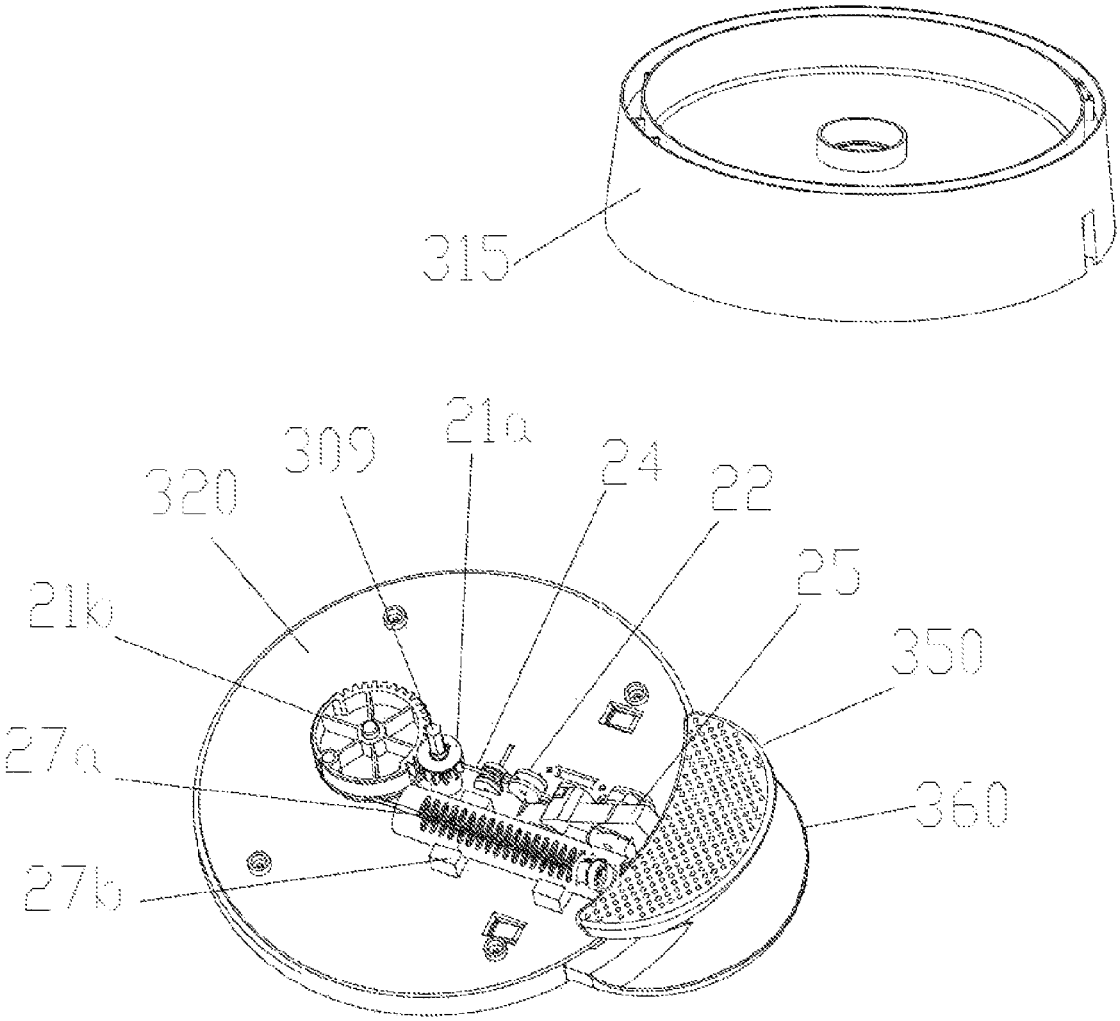
FIG. 8A is a perspective view of the inner parts of the base and pedal of the embodiment of FIG. 1A.
Figure 8B:
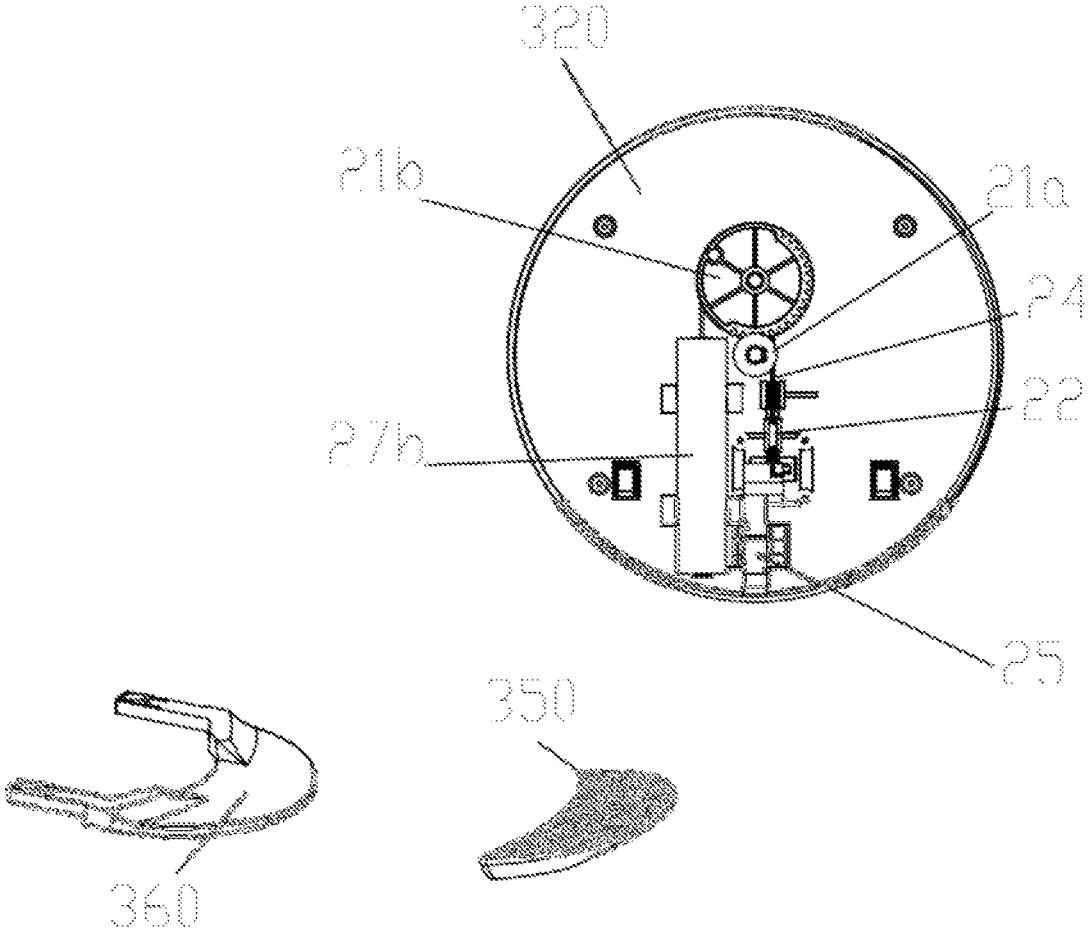
FIG. 8B is a top view of the base and perspective view of the pedal and bracing piece of the embodiment of FIG. 8A.
Figure 8C:
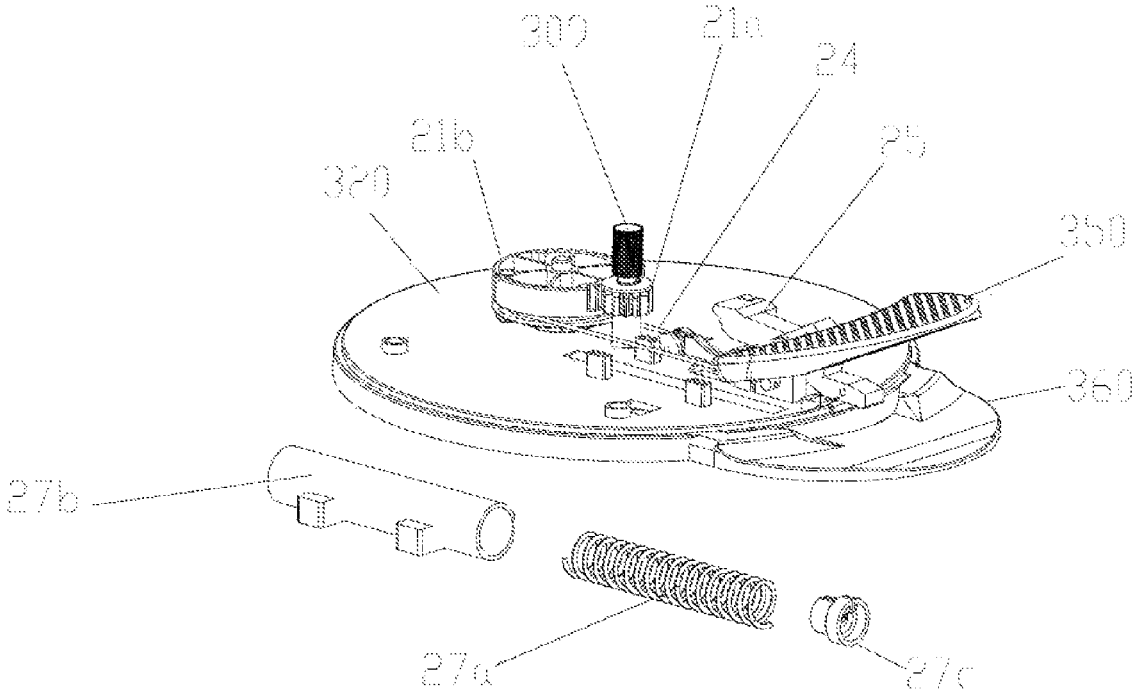
FIG. 8C is another view of the base and pedal of FIG. 8A, where the spring, spring plug, and the spring cover is taken apart.

FIGS. 8A-8B depict close-up views of the internal components in the base 300. In the embodiment shown in FIG. 8A, the base part 320 has the following parts: A spring plug 27*c* is coupled to a spring 27*a*, and a transparent spring cover 27*b* encases both the spring plug 27*c* and spring cover 27*b*. A large gear 21*b* is fixed on the base part 320 and coupled to a small gear 21*a*, which is also fixed on the base part 320. Turning of the large gear 21*b* would in turn rotate small gear 21*a*, which also turns the axle 309 which is attached and sits on top of the small gear 21*a*. Additionally there is a roller 22 which acts as a pulley. A metal wire 24 is attaches at one end near the base of the metal lever 25, and entrains about roller 22, and then about big gear 21*b*, and then enters into spring cover 27*b* and through the center of spring 27*a*, and until its terminal end reaches the spring plug 27*c*. This terminal end is attached to the spring plug 27C. The spring 27*a* is fixed at its end near gear 21B, and has a biasing force pushing the spring plug 27C in an outward direction. As the spring 27*a* pushes spring plug 27C outwardly, it pulls the metal wire taut. When a user steps on the foot pedal 350, it in turn pressed down on the outside leg of the lever 25, causing the inside leg of the lever 25 to go up. Because this leg of the lever is in abutting contact with the metal wire 24, upward movement of this inside leg of the lever 25 also pulls on the metal wire 25, against the roller 22 to which the metal wire 24 is partially leveraged against. As the metal wire 25 begins to pull against the force of the spring 27, the metal wire 25 moves, lengthwise, away from the spring 27*a*, thereby rotates the big gear 21*b*. Rotation of the big gear 21*b* in turn rotates small gear 21*a* and axle 309. Accordingly, the inner barrel 210 is coupled to the axle 309; thus, the inner barrel 210 is driven by the axle 309. FIG. 8B depicts a top view of the embodiment as described above. The parts depicted are part of one embodiment of the mechanics behind the rotational mechanism of the presently claimed invention. One of ordinary skill in the art would immediately recognize that there are other known rotational mechanisms capable of turning the inner barrel 210.

Figure 9A:
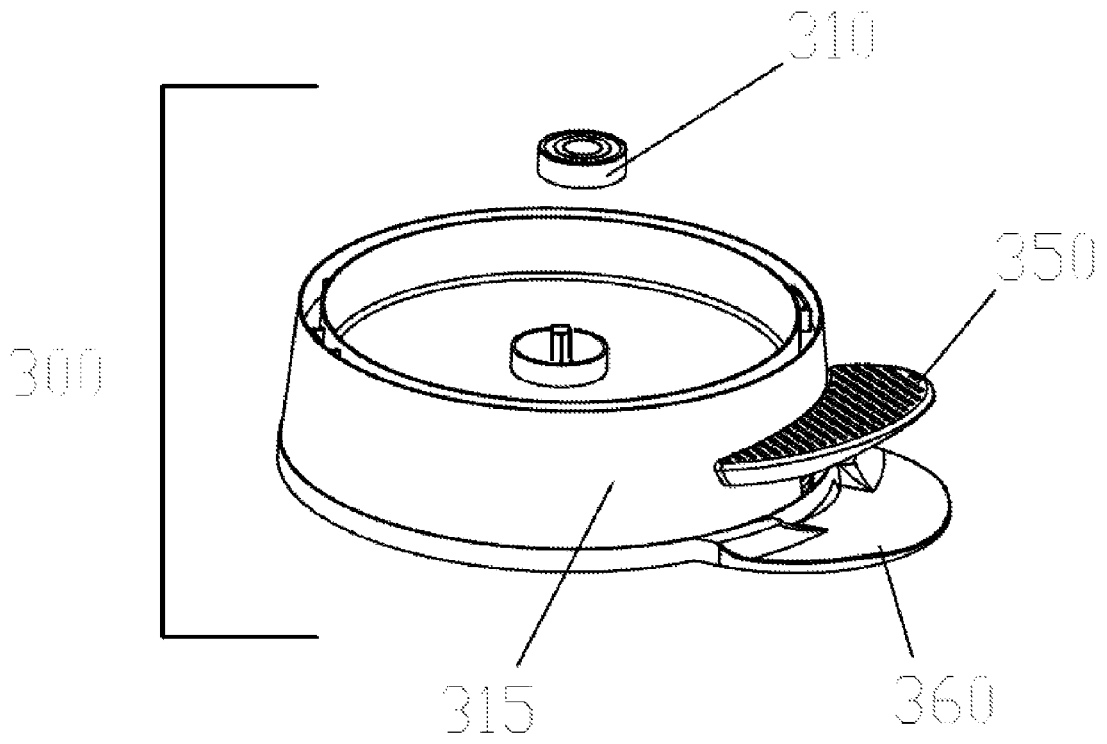
FIG. 9A is a perspective view of a first embodiment of an assembled base having a pedal, where the rotating axle extends through the center.

FIG. 9A is a perspective view of a first embodiment of an assembled base 300. In one embodiment, the main parts of the assembled base 300 as depicted include a base cover 315, base part 320, a pedal 350, and bracing piece 360. Protruding out of the center of the base cover 315 is axle 309. Fitted around the axle 309 is a ball bearing 310, to make rotation of the inner barrel 210 smoother. Along the upper rim of the base cover 315 is a groove with corresponding catches to receive the outer barrel 200. In the preferred embodiment, the outer barrel 200 fits into the groove and locks into place by rotating the outer barrel 200 clockwise.

The bracing piece 360 serves to provide sufficient leverage when compressing the pedal 350 so that the diaper pail 10 does not tip or tilt over. In less preferred embodiments, there is no bracing piece 360.

Figure 9B:
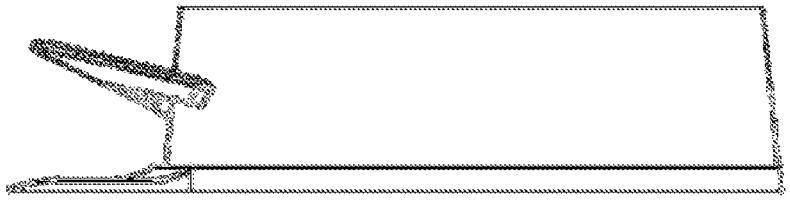
FIG. 9B is a side view of a first embodiment of an assembled base.
Figure 9C:
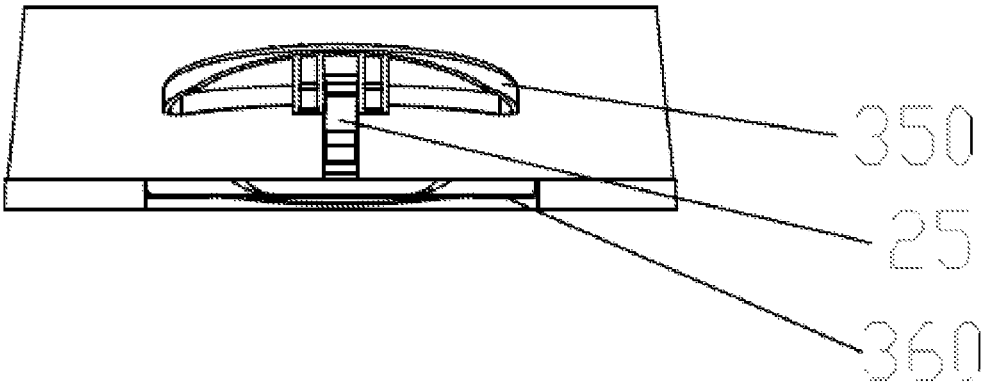
FIG. 9C is a front view of a first embodiment of an assembled base.
Figure 9D:
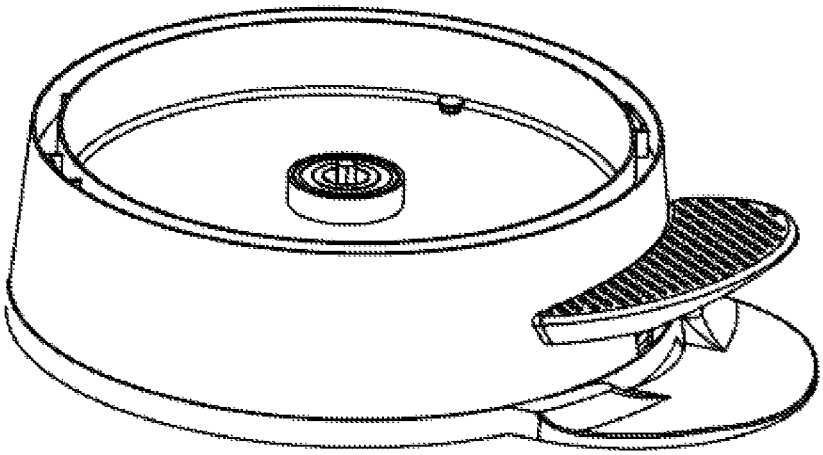
FIG. 9D is a perspective view of the base of FIG. 9A, where a ball bearing is fitted around the axle, yet still allowing the rotating axle to extend therethrough.

FIGS. 9B, 9C, and 9D are different views of the base 300 of FIG. 9A.

Figure 10:
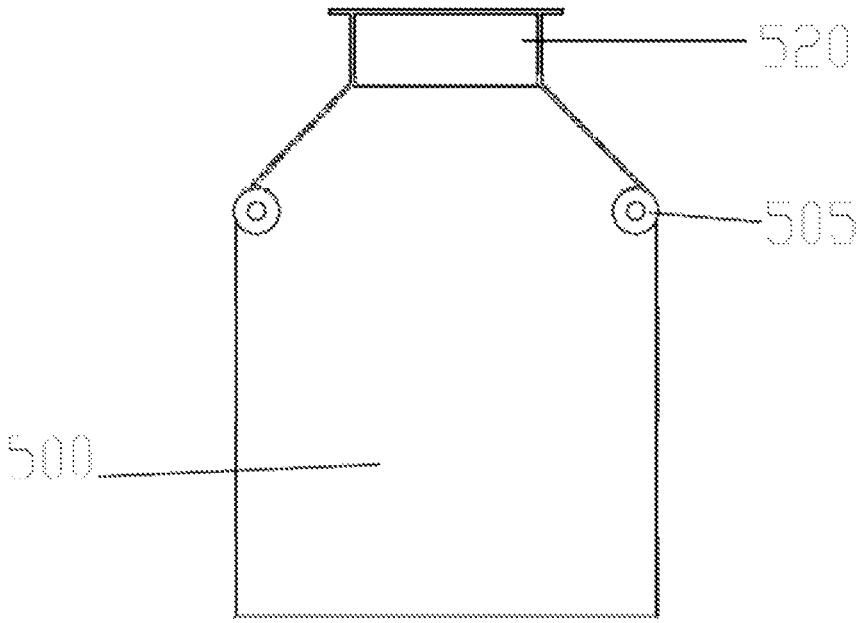
FIG. 10 is a first embodiment of a bag assembly with reinforced apertures.

Referring now to FIG. 10 is a disposable bag 500 having a ring/collar 520 permanently welded together with the bag 500. At the shoulder region are two welded/reinforced circular marks 505, the center of which is perforated, forming a through hole/aperture. The through holes/apertures are for attaching to corresponding bag attachment structures on the inner barrel 210.

Figure 11:
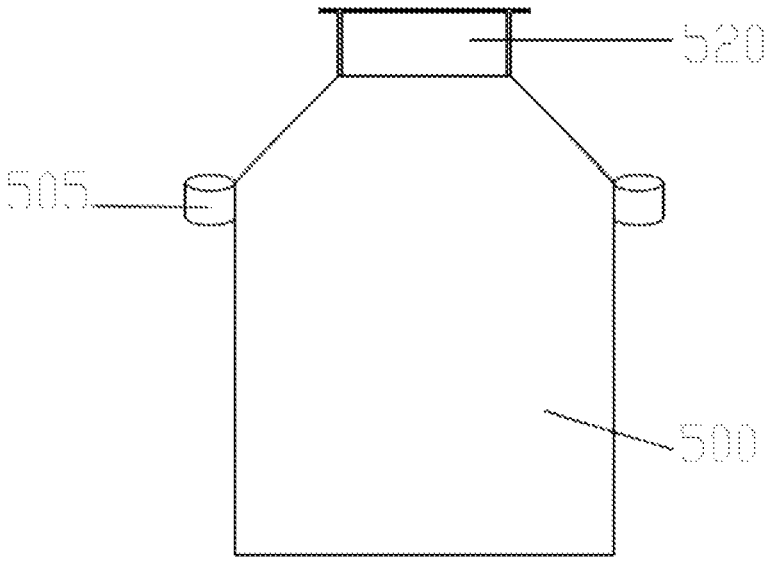
FIG. 11 is a second embodiment of a bag assembly with sleeves.

Similar to FIG. 10, FIG. 11 shows a disposable bag 500, the difference being it has two plastic sleeves 505 disposed on the shoulder region of the bag 500. The sleeves are for attaching the bag 500 to corresponding bag attachment structures on the inner barrel 210. Although the Figure shows two sleeves 505, in some embodiments there can be only one sleeve 505, or than two sleeves 505.

All of the bag assemblies disclosed herein generally have a body portion with an internal space, a neck portion coupled to the body portion, and an opening defined by an upper rim of the disposable bag.

A broad description of the bag assembly would include a bag having some kind of gripper located at or near the upper rim of the bag. The gripper can come in different shapes, sizes, and configurations. In all of the drawing figures, the gripper is illustrated as a circular collar. In another contemplated embodiment, the gripper is a loop structure having a specific shape (circular, rectangular, tubular, flat ring . . . etc.). In yet another contemplated embodiment, the gripper is a loop structure that does not have a specific shape. For example, the loop structure can be an elastic band. Or, the loop structure can have no specific shape (like a loose rope), inelastic, and has a set circumference corresponding to the circumference of the waste container's opening, In still further embodiments, the gripper is not a loop structure, and has clips, hooks, fingers, or other similar gripping structures. In such embodiments, a bag assembly can have a plurality of clips at or near its upper rim, and each of these clips can "grip" onto the opening edge of the waste container.

In another embodiment, where a bag assembly has a plurality of grippers at or near the bag's upper rim, and at least one of the grippers has a notch 530 to receive a corresponding structure on the bag roller 410, or to receive a neck of the bag (thus tying the neck), or both.

As described above, the loop structure can be an elastic band or a cinching strap. In another embodiment, the bag roller 410 has protuberances or surface area types/shapes/configuration/material to facilitate friction between the bag and the bag roller 410, so that the loop structure with an elastic band or a cinching strap 410 can sufficient "grip" onto the bag roller 410.

Referring now to bag assemblies 500 having a circular collar 520, the circular collar 520 is fixed to the upper rim of the bag. While a ring shaped collar 520 is specifically disclosed, as discussed above, it should be noted that a variety of shapes are also contemplated, so long as the shape corresponds to the shape of the waste container opening to which the collar 520 fit into.

The collar 520 is preferably made of semi-rigid material such as plastic or polypropylene (PP). All of the illustrated collars 520 have a vertical wall 527, which has a plane that is parallel to a longitudinal axis of the disposable bag. In other words, the vertical wall forms a continuous loop along the upper rim of the bag, and the continuous loop of vertical wall is curved, forming a tubular structure.

In some embodiments, this vertical wall 527 is not in a continuous loop, but rather punctuated. In other words, it is also contemplated to have only sections or segments of vertical wall 527.

All of the illustrated collars 520 also have an abutting wall 525. It is called an abutting wall 525 because it abuts against the raised rim of the bag roller 410, preventing the collar 520 from slipping downward into the inner barrel 210. The abutting wall 525 is coupled to and perpendicular to the vertical wall. All of the abutting walls 525 as disclosed are a continuous loop of ring structure, where the plane of the abutting wall 525 is entirely flat and not curved (a flat disc). Thus, in contrast to the vertical wall 527, the abutting wall 525 is not curved and does not form a tubular structure.

In some embodiments, this abutting wall 525 is not in a continuous loop, but rather punctuated. In other words, it is also contemplated to have only sections or segments of abutting wall 525 to achieve the same purpose.

Other embodiments contemplate structures other than a "wall" to abut against the rim of the bag roller 410. Contemplated structures include a tab, a protuberance, a rod, a stud, and a finger.

One of the most important elements of the bag assembly 500 is the presence of receiving structure 530 on the collar. One of the purposes of the receiving structure is to receive a twisted neck of the bag assembly 500, obviating the need to tie a knot. The receiving structure 530 can come in different shapes, forms, and can be located at different places on the collar 520. The receiving structure can be a cut out, a notch, and can have protruding finger or non-protruding finger.

Figure 12A:
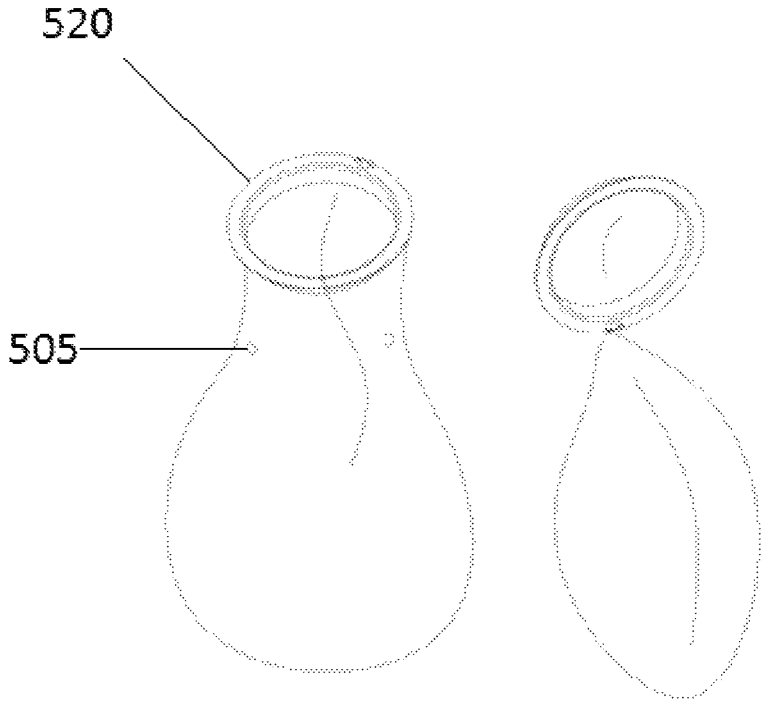
FIGS. 12A-12B is one embodiment of a bag assembly with one type of collar.
Figure 12B:
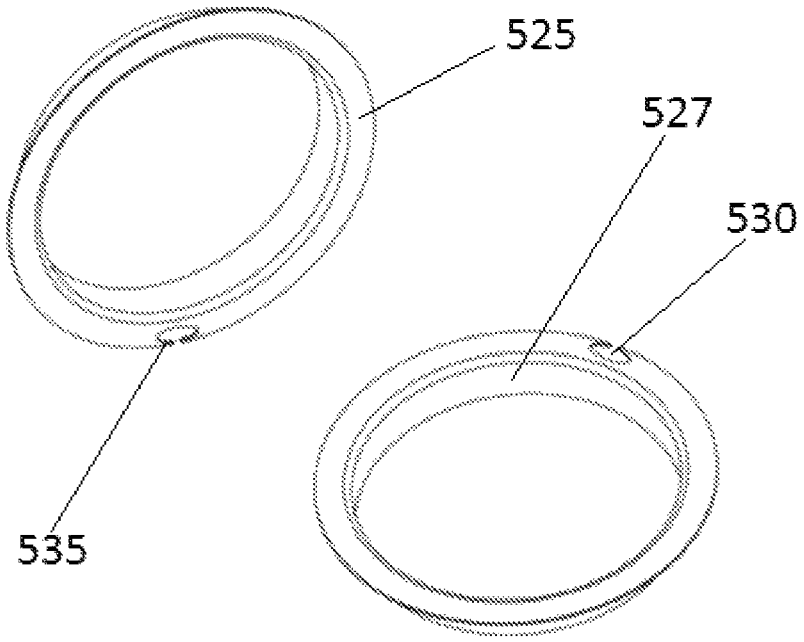

FIG. 12A shows a bag assembly 500 having a first type of receiving structure 530, which is shown closer-up in FIG. 12B. The receiving structure 530 here is an oval cut out on the abutting wall 525. The oval cut out 530 has two fingers 535 pointing towards each other, separated by a gap. The gap is an opening toward the outer circumference of the abutting wall 525. This oval cut out 530 also advantageously receives a protruding anchor when the collar 520 is install on the bag roller (see FIG. 3B). Comparing to FIG. 3C, the protruding anchor is better shown in FIG. 3C because the collar 520 is FIG. 3C does not receive the protruding anchor. This is advantageous because the protruding anchor can hold the collar 520 in position as the bag roller 410 rotates. The figure on the right in FIG. 12A illustrates the neck of the bag being tied off by receiving the twisted neck into the receiving structure 530.

Figure 13A:
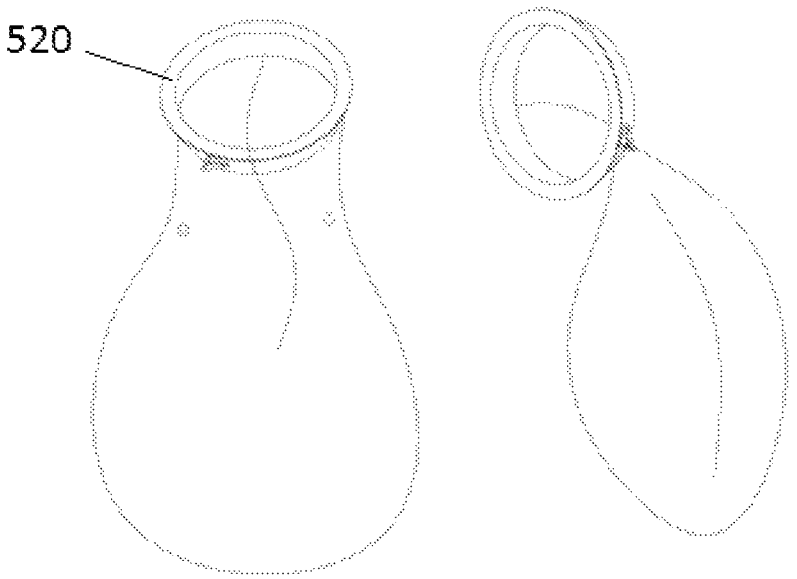
FIGS. 13A-13B is another embodiment of a bag assembly with another type of collar.
Figure 13B:
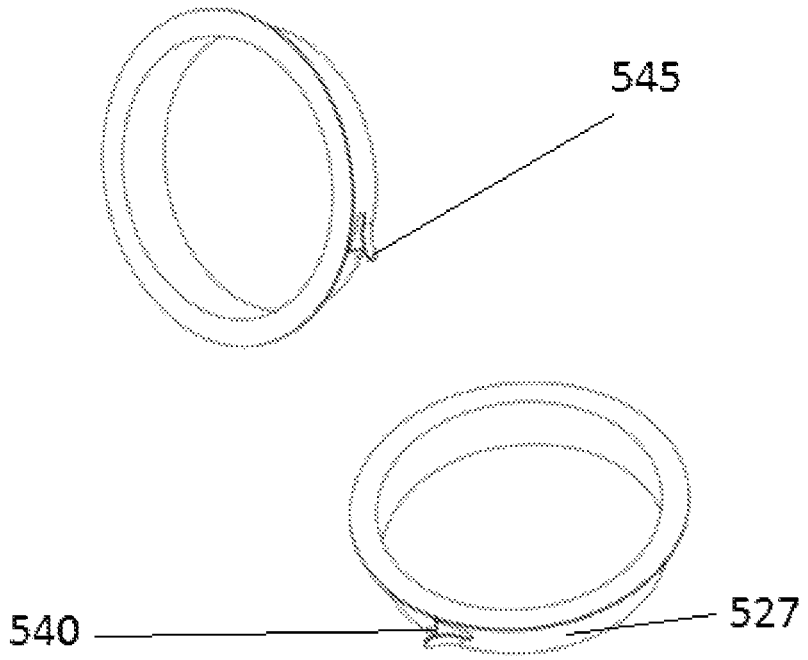

FIG. 13A shows a bag assembly 500 having a second type of receiving structure 530, which is shown closer-up in FIG. 13B. Receiving structure 530 is a notch on the vertical wall 527 having a protruding finger 545. Finger 545 protrudes from the plane of the vertical wall 527, and is not flush with the plane of the vertical wall 527. This is advantageous especially if the bag is made of heavy duty plastic, which would make its twisted neck much thicker thus harder to receive into a receiving structure 530. Thus, protruding finger 527 guides the twisted neck into the notch.

Figure 14A:
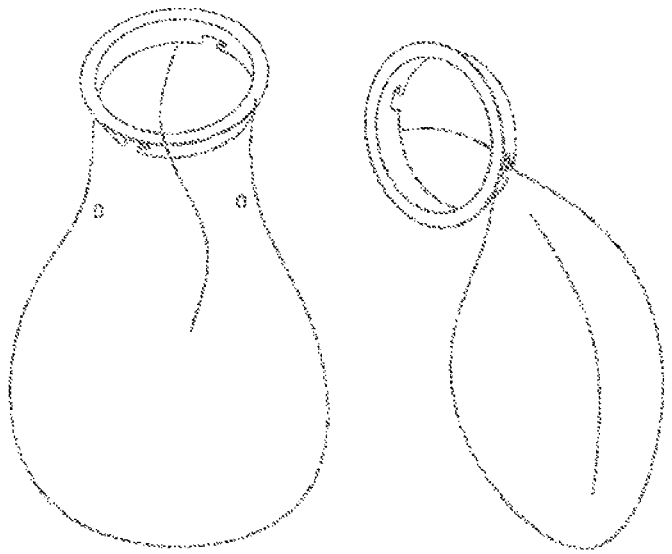
FIGS. 14A-14B is another embodiment of a bag assembly with another type of collar.
Figure 14B:
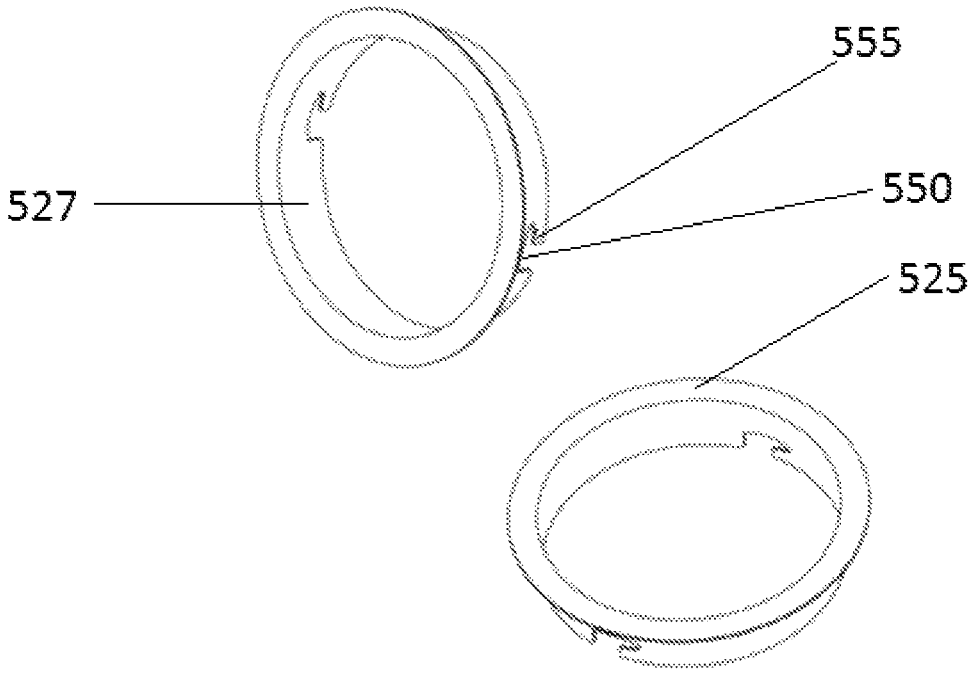

FIG. 14A shows a bag assembly 500 having a third type of receiving structure 530, which is shown closer-up in FIG. 14B. Receiving structure 530 here is L-shaped cut out on the vertical wall 527. The L-shaped cut out has a non-protruding finger that is flush with the vertical wall 527.

Figure 15A:
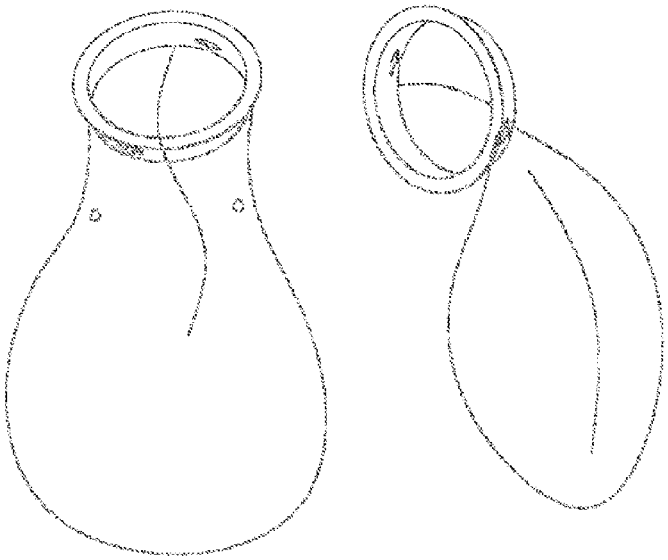
FIGS. 15A-15B is yet another embodiment of a bag assembly with yet another type of collar.
Figure 15B:
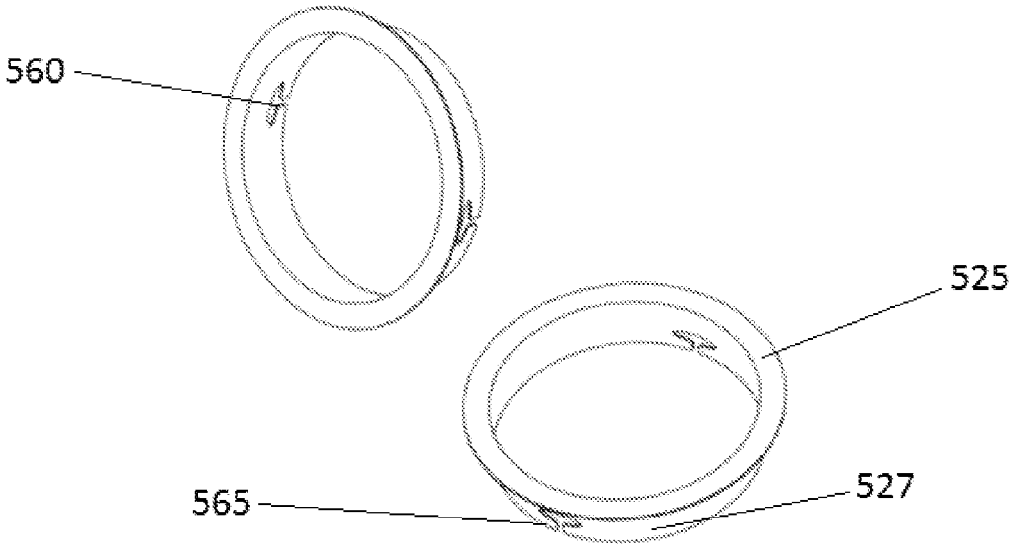

FIG. 15A shows a bag assembly 500 having a fourth type of receiving structure 530, which is shown closer-up in FIG. 15B. Receiving structure 530 here is T-shaped cut out on the vertical wall 527. The T-shaped cut out has two non-protruding fingers pointing towards each other, and both are flush with the plane of the vertical wall 527.

While the embodiments in FIGS. 12A-15B has apertures 505 to mechanically engage with the inner barrel 210, one skilled in the art would immediately recognize that other known and disclosed catches can also be used. For example, the catch can also be a sleeve or a tab.

Another embodiment of the inventive subject matter is a method of waste management for quick and easy garbage handling using a disposable bag and a waste container. The contemplated method includes the step of providing a disposable bag having a semi-rigid collar fixed around the upper rim of the bag, wherein the collar has a receiving structure. Although a semi-rigid collar 520 is preferred to work with the herein disclosed diaper pail, a rigid collar is also contemplated to work with waste containers where the user need not squeeze or deform the collar into an oval shape to fit through a bag roller 410.

In the contemplated methods, the collar 520 has a circumference that substantially corresponds to an opening of the waste container for a snug fit. A user can then insert the collar into the opening and allow the collar 520 to abuttingly couple to the waste container.

The contemplated method further includes the step of attaching a body portion of the bag to a mechanical structure located on an inner wall of the waste container, for reasons described above.

As already discussed, one key feature of the inventive subject matter is to use the collar 520 to close/tie/seal the bag. When the bag assembly 500 is full with waste material, a user simply removes the bag 500 from the waste container by holding and pulling the collar 520 from the bag roller 410, and as the bag hangs in mid-air, turns the body of the bag assembly 500 while holding the collar 520 in place. This would essentially twist the neck portion of the bag assembly 500. After the neck is twisted, a user would then insert the twisted neck into the receiving structure 530 of the collar 520.

Figure 16:
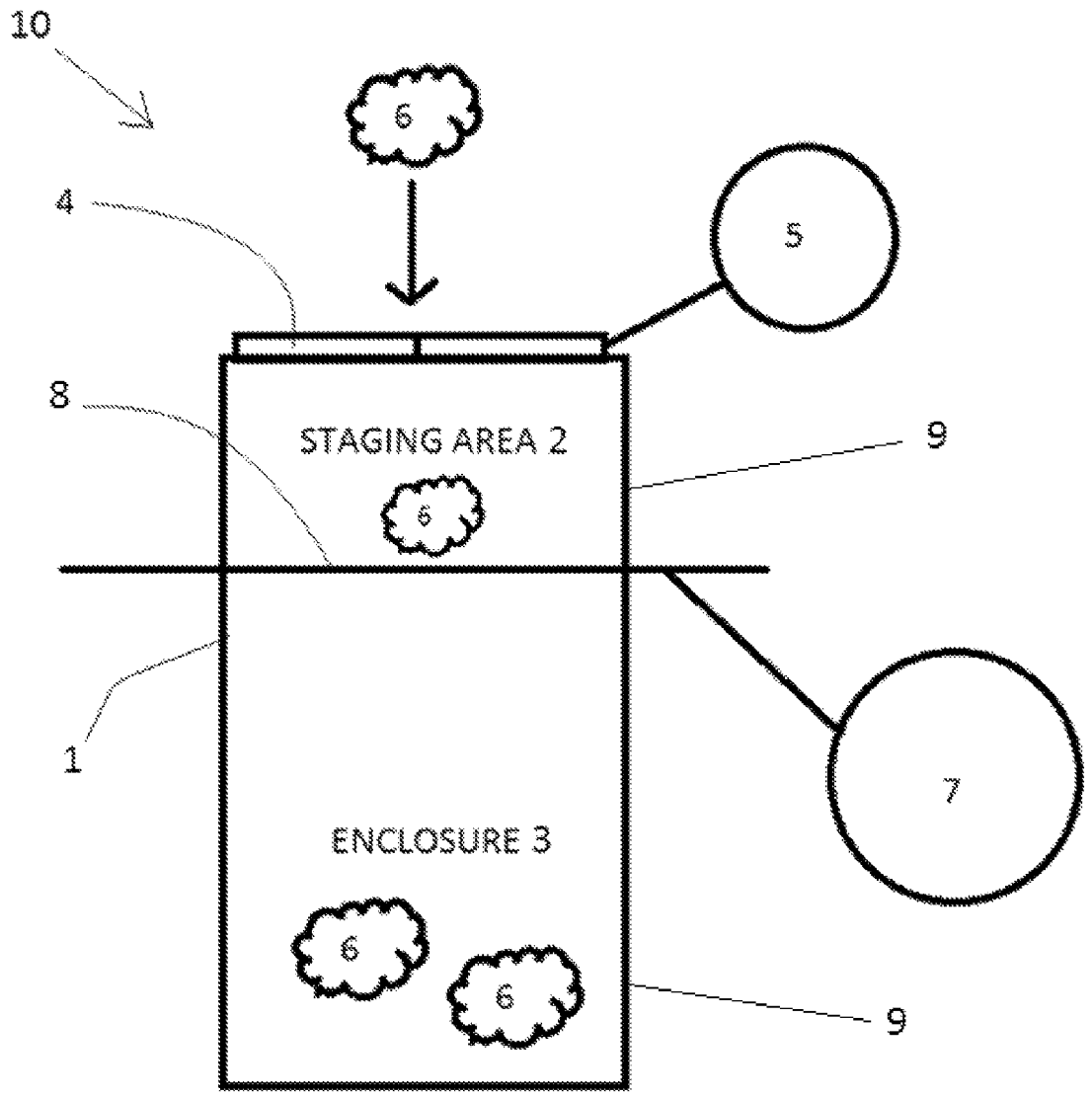
FIG. 16 is a schematic illustrating a more generalized embodiment of the inventive subject matter.

Referring now to FIG. 16, in a more generalized embodiment, a waste disposal system 10 has an enclosure 3 to hold waste material 6. The enclosure 3 is within a container assembly 1. The enclosure 3 can be simply an empty space inside of the container assembly 1. In one embodiment, the enclosure 3 is a disposable bag. In another embodiment, the enclosure 3 is a bucket that fits inside of the container assembly 1.

The container assembly 1 has a top door 4, an outer casing 9 coupled to the top door 4, and an actuator 5 to control an opening and a closing of the top door 4. This actuator 5 can be any known mechanical, electrical, or magnetic types of controller. It can be as simple as a rubber spring as described above, or as complicated as a motorized unit along with a motion sensor to sense a user waving his/her hand to signal the motorized unit to open the top door 4.

The container assembly has a staging area 2 to temporarily hold a waste material for reasons already described. In one embodiment, the staging area is a clearance space between the top door and the entrance 8 to the enclosure. In another embodiment, this clearance space is at least 5 cm.

There is an entrance 8 to the enclosure 3, and the entrance 8 is independently controlled by actuator 7. An opening and closing of the entrance 8 is independent of the opening and closing of top door 4. Operation of actuator 7 can be by a foot pedal and a rotating inner barrel as already described to twist shut the neck (i.e., entrance 8) of the bag. In another embodiment, the actuator can involve a motorized unit that selectively opens and closes another set of doors (i.e., entrance 8) upon pressing of a button (or stepping on a button).

Thus, specific embodiments and applications of a disposable bag have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the invention. In addition, where the specification and claims refer to at least one of something selected from the group consisting of A, B, C . . . and N, the text should be interpreted as requiring only one element from the group, not A plus N, or B plus N, etc.

What is claimed is:

1. A disposable bag to fit around an opening of a waste container, the disposable bag comprising:
- a body portion having an internal space;
- a neck portion coupled to the body portion;
- an opening defined by an upper rim of the disposable bag, and the upper rim is coupled to the neck portion;
- at least one gripper permanently coupled to the upper rim, wherein the gripper makes engaging contact with the opening of the waste container, thereby fixing the upper rim of the bag to the opening of the waste container;
- a notch disposed in a collar forming a cove sufficiently large to encircle the entire neck portion when the neck portion is twisted; and
- a catch disposed on the body portion and above a midline which is equidistant to said gripper and a bottom of said bag.

2. The disposable bag as recited in claim 1, wherein the cove is at least one of a T-shaped cut out or a L-shaped cut out.

3. The disposable bag as recited in claim 1 further comprising at least one protruding finger disposed on the collar adjacent the cove.

4. The disposable bag as recited in claim 1, wherein the body portion has at least one of a reinforced aperture or a sleeve.

5. The disposable bag as recited in claim 1, wherein the gripper is a circular collar.

6. The disposable bag as recited in claim 5, wherein the circular collar has a abutting wall whose plane is perpendicular to a longitudinal axis of the disposable bag.

7. The disposable bag as recited in claim 5, wherein the circular collar has a vertical wall whose vertical plane is parallel to a longitudinal axis of the disposable bag.

8. The disposable bag as recited in claim 7, wherein the circular collar has an abutting wall coupled to and perpendicular to the vertical wall.

9. The disposable bag as recited in claim 7, wherein the notch is disposed on the vertical wall.

10. A disposable bag to make detachable engagement with a waste container, the disposable bag comprising:

a flexible body portion having an internal space;

a neck portion coupled to the body portion;

an opening defined by an upper rim of the disposable bag, and the upper rim is coupled to the neck portion;

at least one gripper fixed to the upper rim of the disposable bag; and a flexible catch disposed below the neck portion and above a midline which is equidistant to said gripper and a bottom of said bag, said flexible catch being permanently disposed on the body portion to receive a corresponding structure of the waste container.

11. The disposable bag as recited in claim 10, wherein the catch is at least one selected from a group consisting of a reinforced aperture, a sleeve, and a tab.

12. The disposable bag as recited in claim 11, further comprising at least one gripper fixed to or near said upper rim of the disposable bag wherein the gripper is a loop structure.

13. The disposable bag as recited in claim 12, wherein the loop structure has an abutting wall whose plane is perpendicular to a longitudinal axis of the bag.

14. The disposable bag as recited in claim 12 further comprising a notch on the loop structure.

15. The disposable bag as recited in claim 14, wherein the notch correspondingly receives a protuberance of the waste container, when the bag is fitted in the container.

16. A method of waste management for quick and easy garbage handling using a disposable bag and a waste container, the method comprising:

providing the disposable bag having a gripper permanently coupled to the upper rim of the bag and a catch disposed on a body portion and above a midline which is equidistant to said gripper and a bottom of the bag, wherein the gripper has a receiving structure;

abuttingly engage the gripper to an opening of the waste container for a snug fit, and attaching and securing a body portion below a neck portion of the bag to a mechanical structure located on an inner wall of the waste container.

17. The method as recited in claim 16, wherein a receiving structure is at least one selected from the group consisting of an oval shaped notch, a T-shaped notch, and a protruding finger.

18. The method as recited in claim 16, further comprising the step of removing the bag from the waste container and then receiving a neck portion of the bag when it is twisted in the receiving structure of the gripper.

19. The method as recited in claim 17, wherein the gripper is a loop structure.

* * * * *